US011118611B2

(12) United States Patent
Cannata

(10) Patent No.: US 11,118,611 B2
(45) **Date of Patent: *Sep. 14, 2021**

(54) CYLINDER ON DEMAND HYDRAULIC DEVICE

(71) Applicant: TONAND INC., London (CA)

(72) Inventor: Antonio Cannata, London (CA)

(73) Assignee: TONAND INC., London (CA)

( * ) Notice: Subject to any disclaimer, the term of this patent is extended or adjusted under 35 U.S.C. 154(b) by 42 days.

This patent is subject to a terminal disclaimer.

(21) Appl. No.: 16/663,967

(22) Filed: Oct. 25, 2019

(65) Prior Publication Data

US 2021/0123464 A1 Apr. 29, 2021

(51) Int. Cl.

| | |
|---|---|
| ***F15B 15/20*** | (2006.01) |
| ***F15B 15/14*** | (2006.01) |
| ***F15B 1/26*** | (2006.01) |
| *F15B 5/00* | (2006.01) |

(52) U.S. Cl.

CPC ..... *F15B 15/204* (2013.01); *F15B 15/1404* (2013.01); *F15B 15/149* (2013.01); *F15B 1/26* (2013.01); *F15B 5/003* (2013.01)

(58) Field of Classification Search

CPC ..... F15B 51/204; F15B 15/149; F15B 1/26; F15B 15/1404; F15B 11/165; F04B 49/24; F04B 29/243; F04B 49/246

See application file for complete search history.

(56) References Cited

U.S. PATENT DOCUMENTS

| | | | |
|---|---|---|---|
| 3,175,510 A | 3/1965 | Amato | |
| 3,866,419 A | 2/1975 | Paul | |
| 6,216,456 B1 | 4/2001 | Mitchell | |
| 6,422,009 B1 * | 7/2002 | Nozawa | F04B 49/002 60/447 |
| 7,014,429 B2 | 3/2006 | Gray | |

(Continued)

FOREIGN PATENT DOCUMENTS

| | | |
|---|---|---|
| CN | 1254059 A | 5/2000 |
| CN | 100362247 C | 1/2008 |

(Continued)

OTHER PUBLICATIONS

"Load Sensing System article", Hawe Hydraulik, retrieved on Feb. 20, 2020 at <https://www.hawe.com/fluid-lexicon/load-sensing-system/>.

*Primary Examiner* — Abiy Teka
*Assistant Examiner* — Daniel S Collins

(57) ABSTRACT

A variable flow hydraulic device having a plurality of cylinders for varying a flow of hydraulic fluid between a reservoir and a load, the device comprising: a housing having the plurality of cylinders with a plurality of corresponding pistons; an input port of the housing fluidly connected to each cylinder of the plurality of cylinders, the input port facilitating introduction of the hydraulic fluid to said each cylinder; a first output port of the housing connected to said each cylinder, the first output port facilitating the ejection of the hydraulic fluid from said each cylinder, the first output port configured for fluidly coupling said each cylinder to the load; a respective flow control valve for said each cylinder, and a fluid pressure sensing device coupled between downstream of the first output port and said respective flow control valve.

21 Claims, 12 Drawing Sheets

(56) References Cited

U.S. PATENT DOCUMENTS

| | | | |
|---|---|---|---|
| 7,983,541 | B2 | 7/2011 | Clements |
| 8,307,752 | B2 | 11/2012 | Ryyppo |
| 8,893,673 | B2 | 11/2014 | Rabhi |
| 9,091,281 | B2 | 7/2015 | Quinnell et al. |
| 9,546,654 | B2 | 1/2017 | Rabhi |
| 9,709,041 | B2 | 7/2017 | Yasuda et al. |
| 2002/0100275 | A1 | 8/2002 | Lisniansky |
| 2003/0206811 | A1 | 11/2003 | Maki et al. |
| 2017/0167474 | A1 | 6/2017 | Cannata |
| 2019/0120215 | A1 | 4/2019 | Cannata |

FOREIGN PATENT DOCUMENTS

| | | | |
|---|---|---|---|
| CN | 206607620 | U | 11/2017 |
| GB | 621393 | A | 4/1949 |
| WO | 2017214708 | A1 | 12/2017 |

* cited by examiner

CYLINDER ON DEMAND HYDRAULIC DEVICE

FIELD

The present disclosure relates to hydraulic devices.

BACKGROUND

Hydraulic pumps and motors are used predominantly in industry when mechanical actuation is desired to convert hydraulic pressure and flow into torque and angular (rotation). Examples of hydraulic application can be in braking systems, propulsion systems (e.g. automotive, drilling) as well as in electrical energy generation systems (e.g. windmills). Other common uses of hydraulic devices as a direct drive system can be in drilling rigs, winches and crane drives, wheel motors for vehicles, cranes, and excavators, conveyor and feeder drives, mixer and agitator drives, roll mills, drum drives for digesters, kilns, trench cutters, high-powered lawn trimmers, and plastic injection machines. Further, hydraulic pumps, motors, can be combined into hydraulic drive systems, for example one or more hydraulic pumps coupled to one or more hydraulic motors constituting a hydraulic transmission.

Due to currently available configurations, there exists disadvantages with hydraulic devices when operated in systems exhibiting dynamic variation fluid flow requirements. For example, the torque requirements of a load in a hydraulic system can dynamically change, such that the hydraulic device must instantaneously react to the changing flow conditions dictated by the dynamic change in the torque.

In terms of current axial piston pump configurations, there exists mechanical complications in the design and use of variable angle rotating drive plates (i.e. wobble plate), in order to dynamically change the fluid flow in response to the changing torque conditions. As such, current axial piston pump designs tend to have higher than desired maintenance costs and issues, are considered operationally inefficient as compared to other reciprocating piston pump designs, and more importantly, current axial piston pumps and motors produce vibration/noise (e.g. Fluidborne noise and Structuralborne Noise). Considered by the industry as the two primary, potentially unsolvable and unwanted problems.

SUMMARY

It is an object of the present invention to provide a hydraulic device to obviate or mitigate at least some of the above presented disadvantages.

It is an object of the present invention to provide a hydraulic pump to obviate or mitigate at least some of the above presented disadvantages.

It is an object of the present invention to provide a hydraulic motor to obviate or mitigate at least some of the above presented disadvantages.

A first aspect provided is a variable flow hydraulic device having a plurality of cylinders for varying a flow of hydraulic fluid with respect to a load, the device comprising: a housing having the plurality of cylinders with a plurality of corresponding pistons; an input port of the housing fluidly connected to each cylinder of the plurality of cylinders, the input port facilitating introduction of the hydraulic fluid to said each cylinder; a first output port of the housing connected to said each cylinder, the first output port facilitating the ejection of the hydraulic fluid from said each cylinder, the first output port configured for fluidly coupling said each cylinder to the load; a respective flow control valve for said each cylinder, said respective flow control valve positioned between at least one of a) the input port and said each cylinder and b) the first output port and said each cylinder, said respective flow control valve for facilitating or inhibiting the flow of the hydraulic fluid between the input port and the first output port for said each cylinder depending upon a respective open state or a respective closed state of said respective flow control valve; and a fluid pressure sensing device coupled between downstream of the first output port and said respective flow control valve, the fluid pressure sensing device for supplying a pressure signal generated from a fluid pressure of the first output port to said respective flow control valve for operating said respective flow control valve between the open state and the closed state; wherein when the pressure signal represents the fluid pressure as exceeding a specified maximum pressure threshold, said respective flow control valve is operated from the closed state to the open state in order to facilitate the flow of the hydraulic fluid between the input port and the first output port via said each cylinder, such that said each cylinder of the plurality of cylinders has a different one of the specified maximum pressure threshold.

BRIEF DESCRIPTION OF THE DRAWINGS

The foregoing and other aspects will now be described by way of example only with reference to the attached drawings, in which.

DETAILED DESCRIPTION

Figure 1:
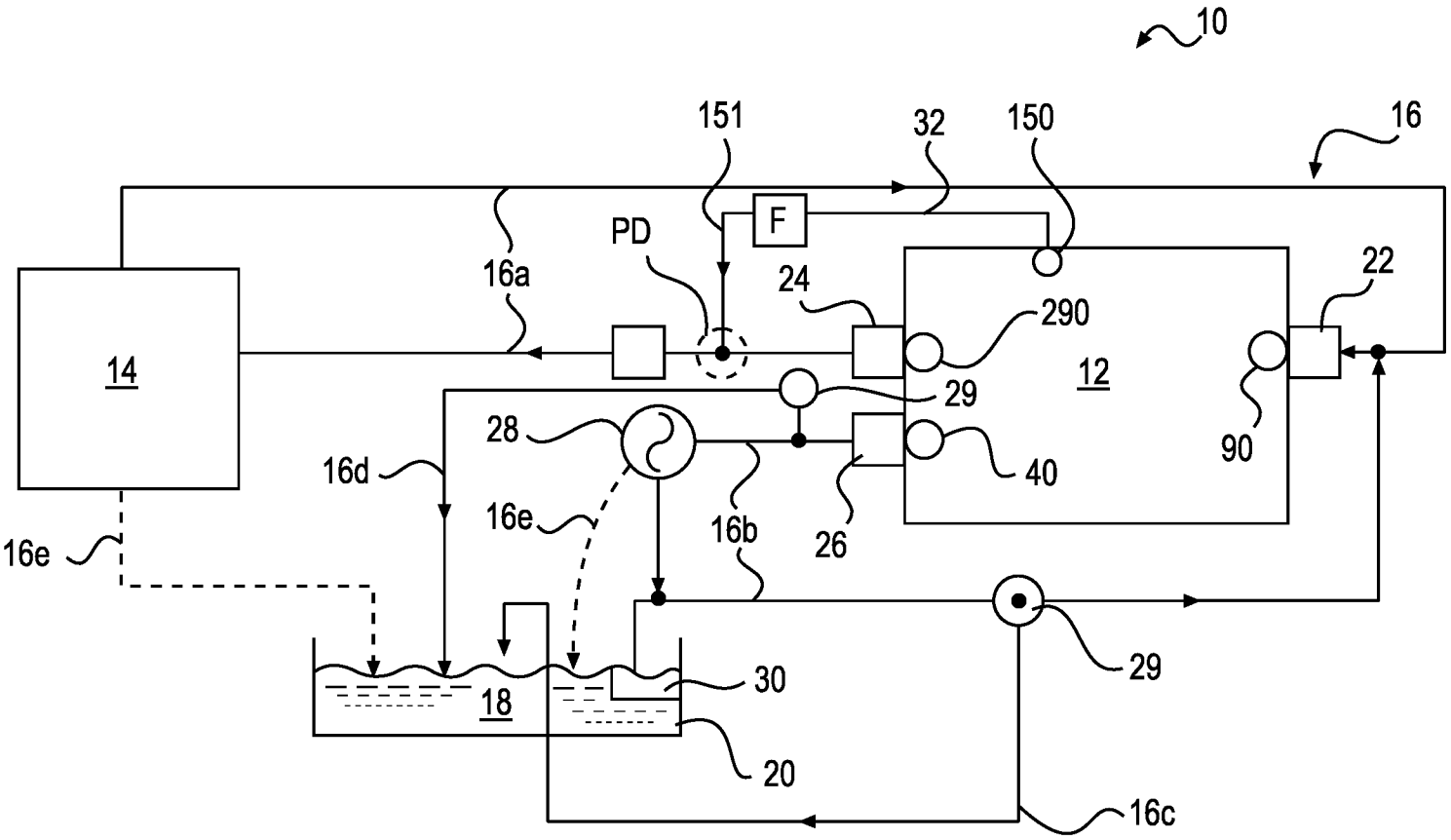
FIG. 1 refers to a schematic for a hydraulic system coupling a hydraulic device to a load.

Referring to FIG. 1, shown is a hydraulic system 10 having a hydraulic device 12 (e.g. pump) connected to a load 14 (e.g. a hydraulic motor) by a plurality of hydraulic fluid conduits 16. The hydraulic device 12 receives hydraulic fluid 18 from a reservoir 20 via input port 22. The hydraulic device has a plurality of cylinders 120 with corresponding pistons 110 (see FIG. 2) for receiving the hydraulic fluid from the input port 22 and outputting the hydraulic fluid via reciprocation of the pistons 110 within their respective cylinders 120. The output of the hydraulic fluid from the hydraulic device 10 can be via a first output port 24 and/or a second output port 26, as further described below. The reciprocation of the pistons 110 within their respective cylinders 120 can be driven by a cam 122 mounted on a crankshaft 123, see FIG. 2. It is recognized that the pistons 110 have a fixed stroke length when reciprocating in their respective bores (i.e. cylinders 120). As such, a distance between a Top Dead Center TDC and Bottom Dead Center BDC (see FIG. 2) remains constant when flow control valves 36 are operated between a closed state and an open state. The position TDC can be defined as when the piston 110 reaches the end of the exhaust stroke for ejecting fluid out of the cylinder 120, and thus the beginning of the intake stroke for injecting fluid into the cylinder 120. The position BDC can be defined as when the piston 110 reaches the end of the intake stroke for injecting fluid into the cylinder 120, and thus the beginning of the exhaust stroke for ejecting fluid out of the cylinder 120. The configuration of the piston 110-cylinder 120 arrangements can be referred to as an axial configuration.

Referring again to FIG. 1, the first output port 24 is fluidly coupled by the hydraulic fluid conduits 16 to the load 14, such that hydraulic fluid leaving the first output port 24 is used to hydraulically drive the load 14 (e.g. to drive reciprocation of pistons when the load is a hydraulic motor). Once the hydraulic fluid has done work with the load 14, the hydraulic fluid can return to the input port 22 as shown by example as a closed loop system. Alternatively, the hydraulic fluid could be returned from the load 14 to the reservoir 20, as shown in ghosted line 16*e*, i.e. as an open loop system. Further, the second output port 26 is connected by the hydraulic conduits 16 to the fluid reservoir 20, by way of a heat exchanger 28. It is recognized that the arrows associated with the hydraulic conduits 16 represent direction of fluid flow. Accordingly, any hydraulic fluid output by the hydraulic device 12 by way of the second output port 26 would be cooled via the heat exchanger 28 and then returned to the input port 22, for example via the fluid reservoir 20 as shown. It is recognized that the fluid reservoir 20 can employ a charge pump 30 (e.g. a gerotor pump or gear pump as desired) in order to supply the hydraulic device 12 with the hydraulic fluid 18 from the reservoir 20 as shown. It is also recognized that the charge pump 30 (e.g. a gerotor pump or gear pump as desired) can be coupled directly to the shaft (e.g. shaft 123) of the hydraulic device 12, e.g. internal to the housing 34, in order to supply the hydraulic device 12 with the hydraulic fluid 18 from the reservoir 20 as shown.

Accordingly, as shown in FIG. 1, any hydraulic fluid leaving the hydraulic device 12 can be through a work leg 16*a* (via output port 24) of the hydraulic fluid conduits 16 (e.g. via the load 14) or can be through a cooling (also referred to as bypass) leg 16*b* (via output port 26) of the hydraulic fluid conduits 16 (e.g. via the heat exchanger 28). The heat exchanger 28 can be connected directly between the secondary output port 26 and the input port 22, such that any fluid flowing through the heat exchanger 28 exits the hydraulic device 12 via the secondary output port 26 and flows directly back to the input port 22 via the bypass leg 16*b* as shown, i.e. in this case bypassing the load 14 as well as bypassing the reservoir 20. As further described below, the pressure relief valve 29 connected to the relief line 16*c* can be used when there is a considered oversupply of hydraulic fluid to the hydraulic device 12 (i.e. when the additive flows of fluid from both the heat exchanger 28—as exiting a common secondary output gallery 40, see FIG. 2—combine with the fluid flow from the charge pump 30 as obtained from the reservoir 20).

A fluid pressure sensing line 32, as further described below, is connected to the work leg 16*a* between the load 14 and the first output port 24, in order to provide sensing of the fluid pressure of the hydraulic fluid being supplied to the load 14 (via the first output port 24). As shown, the charge pump 30 supplies hydraulic fluid to the input port 22 of the hydraulic device 12, such that any excess pressure (e.g. pressure greater than a set pressure) of the hydraulic fluid in the hydraulic conduit 16*b* leading to the input port 22 can be released to the reservoir 20 by pressure relief valve 29 (configured by the set pressure) connected by relief hydraulic conduit 16*c* to the reservoir 20. Further, in the event that there is an excess of fluid pressure (e.g. pressure greater than a set pressure) in the cooling leg 16*b* between the secondary output port 26 and the heat exchanger 28, a further pressure relief valve 29 can be used to direct via relief conduit 16*d* the fluid (exiting the pressure relief valve 29) to the reservoir 20.

Figure 2:
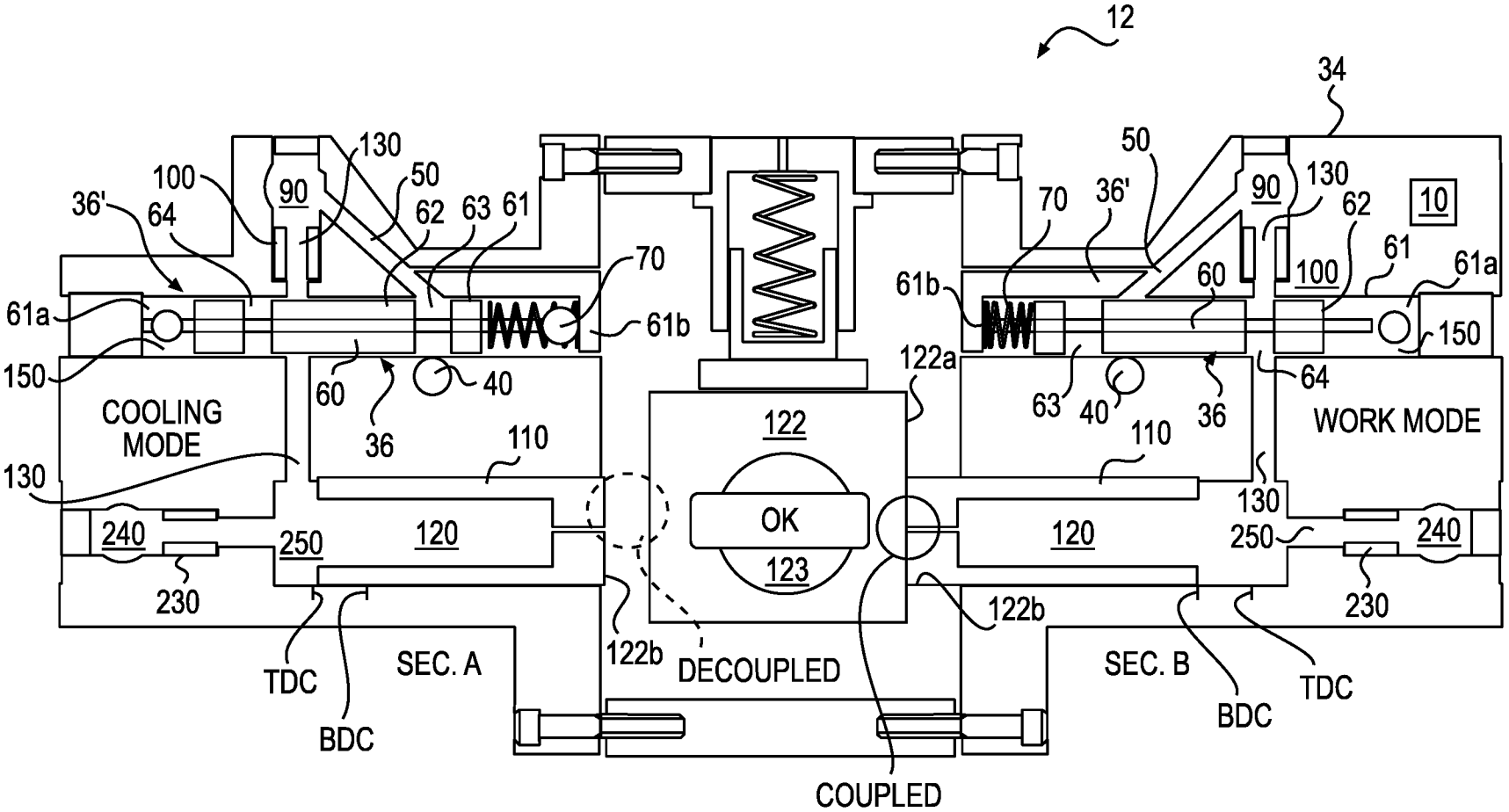
FIG. 2 is a first embodiment of the hydraulic device of FIG. 1 without trigger devices.

Referring to FIGS. 1 and 2, shown is one embodiment of the hydraulic device 12 having a plurality of cylinders 120 and corresponding pistons 110. For example, it is envisioned that the hydraulic device 12 can have any number of piston 110-cylinder 120 arrangements, e.g. 5, 7, 9, etc. However for illustration purposes only, a pair of piston 110—cylinder 120 arrangements is shown. The hydraulic device 12 (also referred to as device 12) has a housing 34 for containing the plurality of piston 110-cylinder 120 arrangements, as driven by the cam 122 having a cam surface 122*a* for driving a piston surface 122*b* of the pistons 110. As discussed above, reciprocation of the pistons 110 within their cylinders 120, when driven by the cam 122, will provide for entry of the hydraulic fluid via input passage 130 into the cylinder 120 (volume), and for exit of the hydraulic fluid via output passage 250 out of the cylinder 120 (volume).

Further, as by example, each of the output passages 250 is fluidly connected to a first output gallery 240 (e.g. by way of a check valve 230 in order to facilitate a one way flow of hydraulic fluid out of the output passages 250), which is fluidly connected to the first output port 24 (see FIG. 1). As such, each of the piston 110-cylinder 120 arrangements can output their hydraulic fluid to the first output gallery 240 common to all piston 110-cylinder 120 arrangements. Further, as by example, each of the input passages 130 is fluidly connected to an input gallery 90 (e.g. by way of a check valve 110 in order to facilitate a one way flow of hydraulic fluid into the input passages 130), which is fluidly connected to the input port 22 (see FIG. 1). As such, each of the piston 110-cylinder 120 arrangements can have their hydraulic fluid input from the input gallery 90 common to all piston 110-cylinder 120 arrangements. It is recognized that any fluid flowing through input passage 130 would be subsequently received by the cylinder 120. Similarly, it is recognized that any fluid flowing through the output passage 250 would be subsequently received by the common output gallery 240. Similarly, any fluid flowing in the bypass passage 50 would be subsequently received by the common second output gallery 40 (e.g. bypass gallery 40). Further, the common input gallery 90 can also be fluidly connected by respective bypass passages 50 to a bypass gallery 40 that is commonly associated with all of the piston 110-cylinder 120 arrangements.

A flow control valve 36 (for each piston 110-cylinder 120 arrangement) can be positioned between the common input gallery 90 (across bypass passage 50) and the common bypass gallery 40, and also between the common input gallery 90 (across input passage 130) and the cylinder 120. As further described below, depending upon the operational state of the flow control valve 36 (e.g. an open state or a closed state), the flow control valve 36 can 1) inhibit flow of the hydraulic fluid between common input gallery 90 and the first output gallery 240 (i.e. by way of the piston 110-cylinder 120 arrangement); allow flow of the hydraulic fluid between common input gallery 90 and the first output gallery 240 (i.e. by way of the piston 110-cylinder 120 arrangement); inhibit flow of the hydraulic fluid between common input gallery 90 and the second output gallery 40 (i.e. by way of the bypass passage 50); and allow flow of the hydraulic fluid between common input gallery 90 and the second output gallery 40 (i.e. by way of the bypass passage 50).

In FIG. 2, by example, the flow control valve 36 associated with the piston 110—cylinder 120 arrangement labelled SEC A would be considered in the closed state. The valve components 36' (described by example below) of the flow control valve 36 are blocking flow of the fluid between the common input gallery 90 and the cylinder 120 (e.g. blocking input passage 130), while allowing the flow of fluid between the common input gallery 90 and the common second output gallery 40 (e.g. via open bypass passage 50). Accordingly, as shown by example for the hydraulic device 12 embodiment of FIG. 2. During cyclic operation of the cam 122, the arrangement SEC A is configured by the closed state of its respective flow control valve 36 to send fluid from the common input gallery 90 directly to the common bypass gallery 40. Thus the arrangement SEC A does not send fluid out of the first output port 24 while the cam 122 rotates, rather any fluid input to the arrangement SEC A flows straight to the second common output gallery 40. As further described below, any fluid entering the common second output gallery 40 can be directed within the housing 34 (e.g. by passage 41) back to the common input gallery 90 (or directed by the passage 41 back to the input port 22), for use by other piston 110-cylinder 120 arrangements (e.g. arrangement SEC B). Alternatively, or in addition to, any fluid entering the common second output gallery 40 can be delivered to the second output port 26 for delivery to the heat exchanger 28 via the hydraulic fluid conduits of leg 16*b*.

In FIG. 2, by example, the flow control valve 36 associated with the piston 110-cylinder 120 arrangement labelled SEC B would be considered in the open state. The valve components 36' (described by example below) of the flow control valve 36 are allowing flow of the fluid between the common input gallery 90 and the cylinder 120 (e.g. via open input passage 130), while blocking the flow of fluid between the common input gallery 90 and the common second output gallery 40 (e.g. blocking bypass passage 50). Accordingly, as shown by example for the hydraulic device 12 embodiment of FIG. 2. During cyclic operation of the cam 122, the arrangement SEC B is configured by the open state of its respective flow control valve 36 to send fluid from the common input gallery 90 to the common first output gallery 240 by way the input passage 130 and output passage 250. Thus the arrangement SEC B does send fluid out of the first output port 24, while the cam 122 rotates, and thus powers or otherwise hydraulically drives the load 14. It is also recognized that the open state can be referred to as a first state and the closed state can be referred to as a second state. As such, the first state can refer to the flow control valve 36 as positioned to direct hydraulic fluid from the input gallery 90 to the first output gallery 240 and the second state can refer to the flow control valve 36 as positioned to direct hydraulic fluid from the input gallery 90 to the second output gallery 40, depending upon the configuration of the various fluid passages of the housing 34. Alternatively, the first state can refer to the flow control valve 36 as positioned to direct hydraulic fluid from the input gallery 90 to the second output gallery 40 and the second state can refer to the flow control valve 36 as positioned to direct hydraulic fluid from the input gallery 90 to the first output gallery 240, depending upon the configuration of the various fluid passages of the housing 34.

Thus, as described above, the hydraulic device 12 embodiment shown in FIG. 2 would have only one piston 110-cylinder 120 arrangement SEC B supplying the load 14 via the first output port 24 (i.e. the flow control valve 36 associated with the arrangement SEC B is in the open state). As discussed, the piston 110-cylinder 120 arrangement SEC A would be inhibited from supplying the first output port 24 by the respective flow control valve 36 (in the closed state) associated with the arrangement SEC A. In other words, the input passage 130 of arrangement SEC A is blocked from supplying fluid from the common input gallery 90 to the common first output gallery 240, while the input passage 130 of arrangement SEC B is allowed to supply fluid from the common input gallery 90 to the common first output gallery 240, thus configuring the hydraulic device 12 as having only one of a pair of piston 110-cylinder 120 arrangements (i.e. SEC A and SEC B) supplying output hydraulic fluid to the first output port 24 (which subsequently supplies the load 14 via the work leg 16*a* of the hydraulic fluid conduits 16). As shown in FIG. 2, the piston 110 of the arrangement SEC A is decoupled from the cam 122, i.e. piston surface 122*b* and cam surface 122*a* are out of contact with one another and as such the piston 110 of arrangement SEC A does not reciprocate within its cylinder 120.

Figure 3:
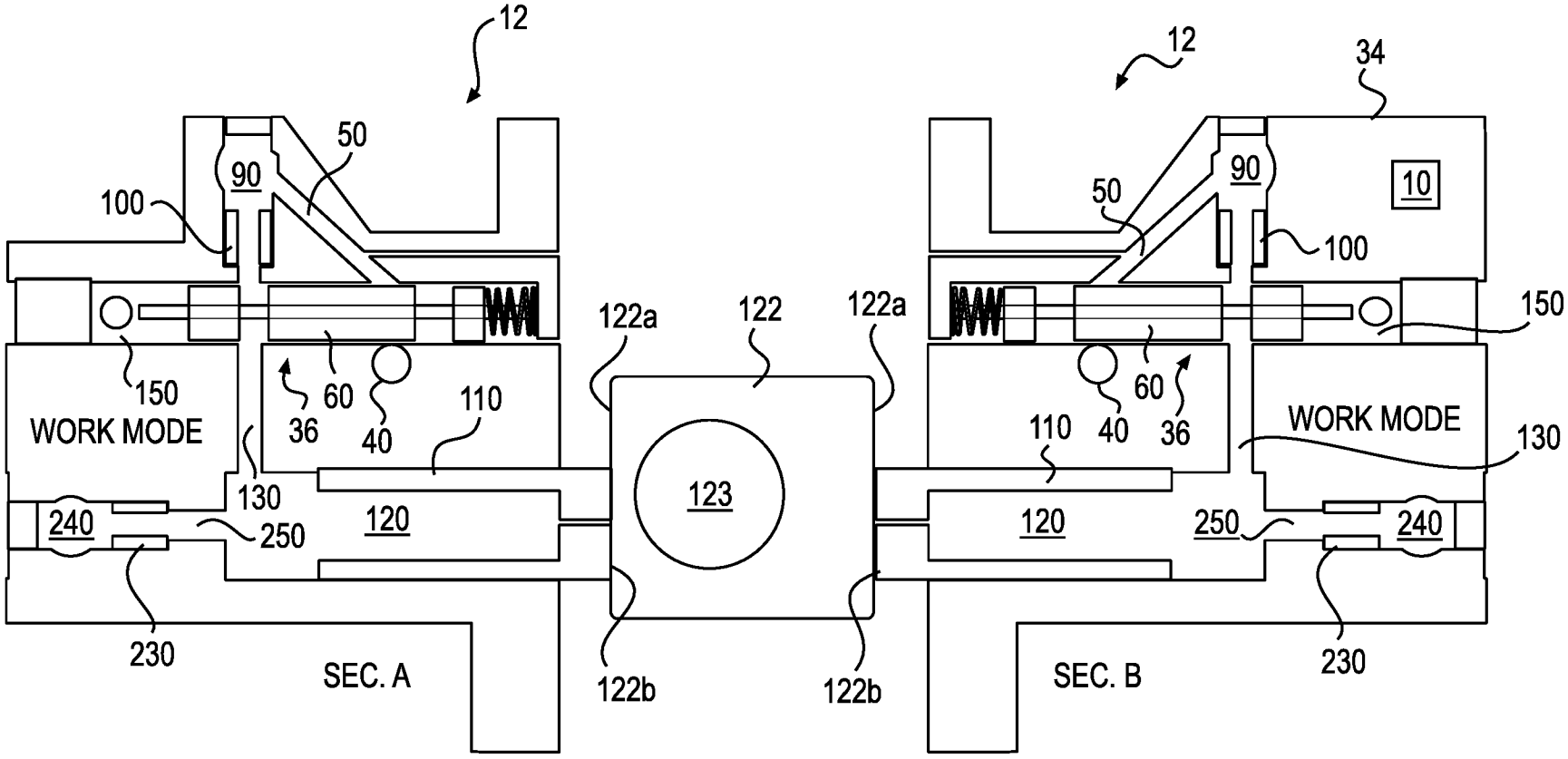
FIG. 3 is a view of the hydraulic device of FIG. 2 with both arrangements in an open mode.

Referring to FIG. 3, shown is a further operational mode of the hydraulic device of FIG. 2, such that both the arrangement SEC A and the arrangement SEC B are supplying hydraulic fluid to the first output port 24, in view of the flow control valve 36 of the arrangement SEC A is in the open state, as is the flow control valve 36 of the arrangement SEC B. Accordingly, it is recognized that in the operational mode of FIG. 3 provides double the flow of hydraulic fluid out of the first output port 24, as compared to the operational mode shown in FIG. 2.

In view of FIGS. 2 and 3, these can be used to describe two different case scenarios. The first case scenario is where the hydraulic device is operating at a reduced output mode (as shown by FIG. 2) and then the hydraulic device 12 gets a pressure signal P (via fluid pressure sensing line—see FIG. 1) that changes the state of the flow control valve 36 of arrangement SEC A from the closed state to the open state. Once that change of state occurs, then the hydraulic fluid would flow via input passage 130 of arrangement SEC A into the corresponding cylinder 120. Fluid filling the cylinder 120 of arrangement SEC A would push the corresponding piston 110 down onto the cam surface 122*a* of cam 122, in order for both the pistons 110 of the arrangements SEC A and SEC B to reciprocate as directed by the rotating cam 122. Both pistons 110 would now be coupled to the cam 122 motion. This would, in effect transform the operational mode of the hydraulic device 12 from that shown in FIG. 2 to that shown in FIG. 3. Accordingly, the receipt of the pressure signal P, and resulting change in state of the flow control valve 36 of arrangement SEC A, provides for an increase in volume output of fluid via the first output port 24, as the flow of fluid from arrangement SEC A is now joined to that of the flow of fluid from arrangement SEC B to the common first output gallery 240. The second case scenario is where the hydraulic device 12 is operating at an increased output mode (as shown by FIG. 3) and then the hydraulic device 12 gets the reduced pressure signal P indicating a reduction in fluid pressure (via fluid pressure sensing line 32—see FIG. 1), which then changes the state of the flow control valve 36 of arrangement SEC A from the open state to the closed state, i.e. representing the fact that the pressure magnitude of the fluid pressure sensing line 32 is insufficient to maintain the open position of the flow control valve 36 of SEC A. Once that change of state occurs, then the hydraulic fluid would flow via bypass passage 50 (instead of input passage 130) of arrangement SEC A into the corresponding common second output gallery 40.

Any fluid exiting the cylinder 120 of arrangement SEC A would allow for the corresponding piston 110 to move away from the cam surface 123 of cam 122, in order for the piston 110 of the arrangement SEC A to become decoupled from the rotating cam 122. As such, only the piston 110 of the arrangement SEC B would remain coupled to the cam 122 motion. This would, in effect transform the operational mode of the hydraulic device 12 from that shown in FIG. 3 to that shown in FIG. 2. Accordingly, the receipt of the pressure signal P, representing a decrease in the fluid pressure as per the fluid pressure sensing line 32, and resulting change in state of the flow control valve 36 of arrangement SEC A, provides for a decrease in volume output of fluid via the first output port 24. It is recognized that for a multi piston 110-cylinder 120 arrangement hydraulic device 12 (i.e. having more than 2 piston 110-cylinder 120 arrangements) the number of piston 110-cylinder 120 arrangements operating (i.e. coupled to the cam 122 and thus their output connected to the common first output gallery 240) or inactive (i.e. decoupled from the cam 122 and thus their output connected to the common second output gallery 40) can be two or more, depending upon the number of piston 110-cylinder 120 arrangements available. For an example 5 arrangement hydraulic device 12 (e.g. 2 arrangements operating and 3 arrangements decoupled, 1 arrangement operating and 4 arrangements decoupled, 5 arrangements operating and 0 arrangements decoupled, etc.). Depending upon the pressure signal P, respective ones of the arrangements can be either coupled to the cam 122 (thus directing output to the first output port 24 by way of the common first output gallery 240) or decoupled from the cam 122 (thus directing output towards the second output port 26 by way of the common second output gallery 40).

As discussed above, the flow of hydraulic fluid directed towards the second output port 26, by way of the common second output gallery 40, can 1) exit via the second output port 26 through cooling leg 16*b* (see FIG. 1) and redirected into the common input gallery 90 for subsequent use by any of the piston 110-cylinder 120 arrangements coupled to the motion of the cam 122. For example, for any decoupled piston 110-cylinder 120 arrangements (see arrangement SEC A), any fluid flowing out of the common second output gallery 40 (unless allowed out of the bypass leg by pressure relief valve(s) 29 back to the reservoir 20) would be able to flow via the bypass leg 16*b* to the common input gallery 90 (and thus available to any of the other piston 110-cylinder 120 arrangements considered in the open state (i.e. the piston 110 is coupled to the motion of the cam 122). In this way, subject to any excessive pressure in the bypass leg 16*b*, any hydraulic fluid exiting (via the common secondary output gallery 40) would be cooled and thus fed back to the input port 22 of the hydraulic device 12, recognizing that any hydraulic fluid flowing in the bypass leg 16*b* bypasses the load 14 when exiting (via the secondary output port 26) and subsequently reentering (via the input port 22) the hydraulic device 12.

In view of the above, it is recognized that any hydraulic fluid flowing between the output port(s) 24,26 and the input port 22 in a path that bypasses the fluid reservoir 20 would be considered as a closed loop operation of the hydraulic device 12. Further, it is recognized that any hydraulic fluid flowing between the output port(s) 24,26 and the input port 22 in a path that goes through the fluid reservoir 20 would be considered as an open loop operation of the hydraulic device 12. Accordingly, it is recognized that, except when the pressure relief valves 29 are utilized, the hydraulic device of FIGS. 1,2 can be operated as a closed loop hydraulic device 12.

Further to the above, it is also recognized that the common input gallery 90 (of the input port 22) of the hydraulic device 12 can be supplied (or otherwise supplemented) by a combination of fluid flows, i.e. fluid flow from the work leg 16*a* that is leaving the load 14, fluid flow supplied from the reservoir 20 by the charge pump 30, and/or fluid flow from the bypass (or cooling) leg 16*b* exiting the heat exchanger 28. An advantage of this multi stream fluid flow to the input port 22 is that the charge pump 30 volume output can be reduced, as the flow from the charge pump 30 will be supplemented by the fluid flows exiting the output port(s) 24,26 that bypass the reservoir 20 as described above and shown with reference to FIG. 1. In other words, depending upon the configuration of the system 10 (including the pressure and fluid flow demands of the load 14, the size of the charge pump 30 can be reduced and thus provide cost savings for the equipment and operation of the system 10. It is also recognized that there can be more than one charge pump 30, to account for when there is not enough closed loop flow of the fluid to the input port 22 via the leg(s) 16*a,b* and thus the difference must be made up from that fluid available from the reservoir 20.

Referring again to FIGS. 1 and 2, the operation of the flow control valves 36 is now described, in view of the sensed pressure signal P received via the pressure sensing line 32.

One embodiment of the flow control valve 36 is as a spool valve, such that the valve components 36' include a control cylinder 61 having a shuttle valve 60 having a body 62. The shuttle valve 60 is configured to reciprocate within the control cylinder 61, dependent upon a pressure signal P available at common sensing gallery 150, which is fluidly connected to the work leg 16*a* (between the load 14 and the first output port 24) by pressure sensing line 32—see FIG. 1. The body 62 is also biased by biasing element 70 in order to block the input passage 130 (thus providing a closed state of the flow control valve 36). The body 62 has a bypass port 63 and a work port 64, such that the common input gallery 90 is fluidly coupled to the common second output gallery 40 when the bypass port 63 is aligned with the bypass passage 50—see arrangement SEC A of FIG. 2. Further, when the bypass port 63 is aligned, then the work port 64 is misaligned with the input passage 130 and therefore the common input gallery 90 is fluidly blocked from fluid communication with the common first output gallery 240 (via the reciprocating piston 110-cylinder 120 arrangement)—see arrangement SEC A. Alternatively, the body 62 has the bypass port 63 and the work port 64, such that the common input gallery 90 is fluidly blocked from the common second output gallery 40 when the bypass port 63 is misaligned with the bypass passage 50—see arrangement SEC B of FIG. 2. Further, when the bypass port 63 is misaligned, then the work port 64 is aligned with the input passage 130 and therefore the common input gallery 90 is fluidly coupled for fluid communication with the common first output gallery 240 (via the reciprocating piston 110-cylinder 120 arrangement)—see arrangement SEC B.

In terms of how the ports 63, 64 switch between aligned and misaligned, this depends upon the strength of the pressure signal P in view of the strength of the bias exerted by the biasing element 70, as provided by a pressure sensing device 151. In a first embodiment, the pressure sensing device 151 can be provided hydraulically, such that the pressure sensing device 151 includes the pressure sensing line 32 connected between the work leg 16*a* and the common sensing gallery 150. As such, the hydraulic fluid from the work leg 16*a* (as positioned between the load 14 and the first output port 24) would pressurize the pressure sensing line 32 and fill the common sensing gallery 150. If the magnitude of the pressure of the hydraulic fluid in the common sensing gallery 150 is greater than the magnitude of the bias provided by the biasing element 70, the body 62 would shift in the control cylinder 61 against the bias and thus allow a portion of the fluid from the common sensing gallery 150 (as obtained from the work leg 16*a*) to fill the control cylinder 61 until the ports 63, 64 are aligned.

For example, if the pressure signal P at the common sensing gallery 150 is greater than the strength of the biasing element 70 for the flow control valve 36, then the body 62 would be forced against the bias of the biasing element 70 and this would result in a shift of the body 62 within the control cylinder 61 in a direction towards the biasing element 70. If the magnitude of the pressure signal P is large enough to overcome the bias exerted by the biasing element 70, then the body 62 would shift in the control cylinder 61 such that the work port 64 would become aligned with the input passage 130 and the bypass port 63 would become misaligned with the bypass passage 50 (see SEC B of FIG. 2). Referring further to FIG. 2, the same pressure signal P (experienced by the arrangement SEC B) is also present at the common sensing gallery 150 for the control cylinder 61 of the arrangement SEC A. In this case, the magnitude of the pressure signal P is less than the bias exerted by the biasing element 70 on the body 62 of the arrangement SEC A, and as such the body 62 remains shifted in the control cylinder 61 away from the biasing element 70 and towards the common sensing gallery 150. In this biased position for the arrangement SEC A, the work port 64 is (e.g. remains/becomes) misaligned with the input passage 130 and the bypass port 63 is (e.g. remains/becomes) aligned with the bypass passage 50. In terms of the pair of biasing elements 70 shown in FIG. 2, the biasing element 70 of arrangement SEC A can be of a stronger magnitude (i.e. stronger biasing force) than the biasing element 70 of arrangement SEC B. In other words, each of the plurality of biasing elements for the respective piston 110-cylinder 120 arrangements (of the hydraulic device 12) would have different biasing strengths. In this example, the operation of the flow control valves 36 is coordinated without use of triggering devices 601 (further described below).

Accordingly, in the embodiment described in FIG. 2, the biasing elements 70 are of differing strengths (reflective of different magnitudes of the pressure signal P provided by the common sensing gallery 150 during differing operational/load states of the load 14), such that it is recognized that as the magnitude of the pressure signal P increases (say from a lower fluid pressure towards a higher pressure), serially more and more of the biasing elements 70 will be overcome and thus their corresponding flow control valves 36 will change from the closed state to the open state. Similarly, as the biasing elements 70 are of differing strengths (reflective of different magnitudes of the pressure signal P provided by the common sensing gallery 150 during differing operational/load states of the load 14), it is recognized that as the magnitude of the pressure signal P decreases (say from a higher fluid pressure towards a lower pressure), serially more and more of the biasing elements 70 will be released and thus their corresponding flow control valves 36 will change from the open state to the closed state. In this manner, the hydraulic device 12 is operated as a "cylinder on demand" hydraulic device 12, depending upon the states of the respective flow control valves 36 associated with each of the piston 110-cylinder 120 arrangements of the multi-piston 110—cylinder 120 hydraulic device 12. As discussed above, it is recognized that the operation states of the flow control valves 36 are dependent upon the fluid pressure (of the load 14), as sensed via the pressure sending line 32 (reflected by the pressure signal P).

For example, for a 5 arrangement hydraulic device 12, a biasing element 70 for the first arrangement would have a biasing strength less than a biasing element 70 for the second arrangement, the biasing element 70 for the second arrangement would have the biasing strength less than a biasing element 70 for the third arrangement, the biasing element 70 for the third arrangement would have the biasing strength less than a biasing element 70 for the fourth arrangement, and the biasing element 70 for the fourth arrangement would have the biasing strength less than a biasing element 70 for the fifth arrangement. In other words, the biasing element 70 for the fifth arrangement would have the strongest bias force and the biasing element 70 for the first arrangement would have the weakest bias force. In this 5 arrangement example, the as the pressure signal P increased progressively from a strength only just greater than the biasing force of the first arrangement towards a strength equal to or greater than the biasing force for the fifth arrangement, the hydraulic device 12 would have the first arrangement coupled to the first output port 24 and then iteratively the second arrangement followed by the third arrangement followed by the fourth arrangement followed by the fifth arrangement becoming coupled to the first output port 24 until the hydraulic device 12 had all 5 arrangements combined to pump their respective cylinder 120 volumes to the common first output gallery 240, and thus out of the first output port 24 and to the load 14 via the work leg 16*a*. In other words, each of the piston 110-cylinders 120 would become "on demand", as their respective flow control valves 36 changed from the closed state to the open state.

For the operation of the flow control valves 36, in terms of the body 62 of the control valve 60 shifting back towards the common sensing gallery 150, as the magnitude of the pressure signal P drops, any fluid present in the control cylinder 61 (used in the earlier displacement of the body 62 against the bias of the biasing element 70) would be forced to return to the common sensing gallery 150 and ultimately back into the work leg 16*a* via the pressure sensing line 32. This return of the fluid back into the common sensing gallery 150 would be caused by the bias of the biasing element 70 overcoming the relatively weaker pressure (i.e. reflective of pressure signal P) of the hydraulic fluid in the control cylinder 61.

Referring again to FIG. 2, as one embodiment of the flow control valve, the control cylinder 61 has one end 61*a* having the common sensing gallery 150 and another end 61*b* having the biasing element 70, such that the body 62 is positioned in the control cylinder 61 between the common sensing gallery 150 and the biasing element 70.

Referring again to FIG. 1, in an alternative embodiment, the fluid pressure sensing device 151 can include a pressure transducer PD (see ghosted view) for sensing the fluid pressure in the work leg 16*a* and generating an electronic signal P as the pressure signal P for use by the respective flow control valve 36 to operate from the closed state to the open state. For example, the flow control valve 36 could include a solenoid 608 (for example see FIG. 4) operated by the electronic signal P, when received. In this example, the flow control valve 36 would be operated electronically, rather than hydraulically as shown in FIGS. 2 through 11.

Figure 4:
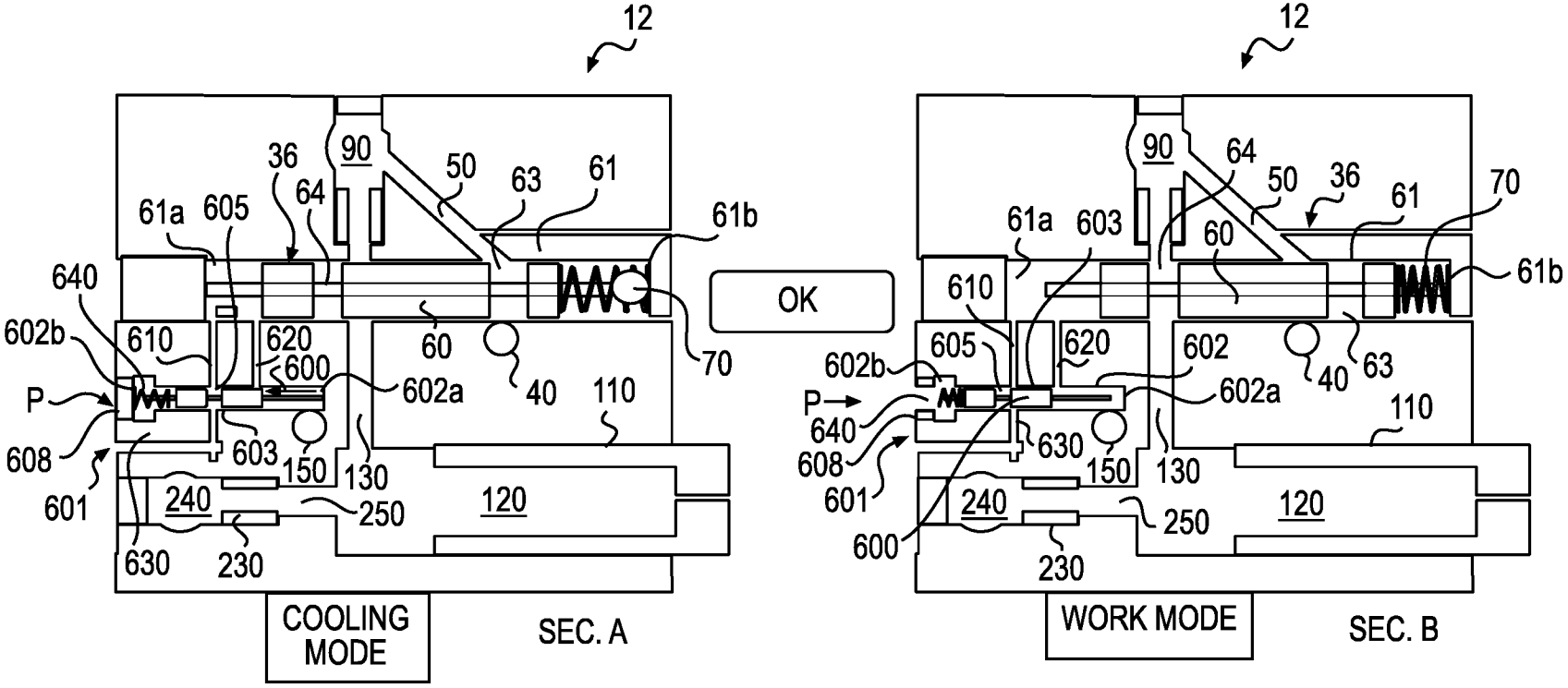
FIG. 4 is a further embodiment of the hydraulic device of FIG. 2 with trigger devices.

Referring to FIG. 4, shown is a further embodiment of the hydraulic device 12, such that the flow control valve 36 has a trigger device 601. The trigger device 601 is responsible for acting as a trigger for making the respective flow control valve 36 change from a closed state to an open state or from an open state to a closed state. The trigger device 601 has a trigger cylinder 602 with a trigger valve 600 (having a trigger body 603) configured for reciprocation within a trigger cylinder 602. The common sensing gallery 150 is positioned at one end 602*a* of the trigger cylinder 602 and a trigger biasing element 640 is positioned at another end 602*b* of the trigger cylinder 602. The body 603 is positioned between the common sensing gallery 150 and the trigger biasing element 640. In this case, the trigger biasing elements 640 would have the graduated strengths (i.e. different strengths) proportional to the expected pressure rise/decrease of the pressure signal P of the work leg 16*a*. In turn, the biasing elements 70 would be relatively weak (as compared to the trigger biasing elements 640), such that effectively any pressure of the hydraulic fluid allowed to enter the control cylinder 61 by the trigger device 601 would overcome the bias of the biasing element 70 for any of the fluid control valves 36 of the hydraulic device 12. Similarly, in turn, the biasing elements 70 would only be strong enough (as compared to the trigger biasing elements 640), such that any pressure of the hydraulic fluid allowed to leave the control cylinder 61 by the trigger device 601 would facilitate the bias of the biasing element 70 to return any of the fluid control valves 36 of the hydraulic device 12 to their closed state.

In other words, the trigger devices 601 are configured, i.e. the trigger biasing elements 640 are each respectively calibrated for different magnitudes of the pressure signal P, such that if any of them are triggered and thus allow a portion of the hydraulic fluid from the common sensing gallery 150 into the control cylinder 61, then the corresponding flow control valve 36 would change state from the closed state to the open state (i.e. the body 62 would move against the bias of the biasing element 70 and thus cause the work port 64 to become (or otherwise maintain) aligned and the bypass port 63 to become (or otherwise maintain) misaligned—see arrangement SEC B of FIG. 4). Similarly, the trigger devices 601 are configured, such that if any of them are triggered and thus allow the portion of the hydraulic fluid to leave the control cylinder 61 (e.g. to drain back into the common sensing gallery 150 as one embodiment, or to drain back to the reservoir 20 as a second embodiment), then the corresponding flow control valve 36 would change state from the open state to the closed state (i.e. the body 62 would move with the bias of the biasing element 70 and thus cause the work port 64 to become misaligned and the bypass port 63 to become aligned—see arrangement SEC A of FIG. 4).

Accordingly, in the embodiment described in FIG. 4, the biasing elements 640 are of differing strengths (reflective of different magnitudes of the pressure signal P provided by the common sensing gallery 150 during differing operational/load states of the load 14), such that it is recognized that as the magnitude of the pressure signal P increases (say from a lower fluid pressure towards a higher pressure), serially more and more of the biasing elements 640 will be overcome and thus their corresponding flow control valves 36 will change from the closed state to the open state. Similarly, as the biasing elements 640 are of differing strengths (reflective of different magnitudes of the pressure signal P provided by the common sensing gallery 150 during differing operational/load states of the load 14), it is recognized that as the magnitude of the pressure signal P decreases (say from a higher fluid pressure towards a lower pressure), serially more and more of the biasing elements 640 will be released and thus their corresponding flow control valves 36 will change from the open state to the closed state. In this manner, the hydraulic device 12 is operated as a "cylinder on demand" hydraulic device 12, depending upon the states of the respective flow control valves 36 associated with each of the piston 110-cylinder 120 arrangements of the multi-piston 110-cylinder 120 hydraulic device 12. As discussed above, it is recognized that the operation states of the flow control valves 36 are dependent upon the fluid pressure (generated by the load 14), as sensed via the fluid pressure sensing line 32 (reflected by the pressure signal P).

Referring again to FIG. 4, the trigger device 601 of the arrangement SEC B has had the biasing force of the trigger biasing element 640 overcome by the pressure signal P exhibited by the common sensing gallery 150. In other words, the body 603 of the trigger valve 600 has been forced against the bias and towards the another end 602*b*. This has allowed for the portion of the hydraulic fluid to exit the common sensing gallery 150 and enter pressure passage 620 and into the control cylinder 61. As the biasing element 70 of the arrangement SEC B has a relative bias force for the body 62 less than the bias force for the body 603, the body 62 shifts against the bias of the bias element 70 and changes the flow control valve 36 from the closed state to the open state. Referring to arrangement SEC A of FIG. 4, the pressure signal P of the common sensing gallery 150 is not strong enough to overcome the bias of the respective trigger biasing element 640. Thus, a drain port 605 of the body 603 is aligned with a drain passage 610, in order to allow any hydraulic fluid in the control cylinder 61 to leave and thus allow the bias for the biasing element 70 to shift (or otherwise maintain) the body 62 towards the end 61*a* (thereby aligning the bypass port 63 and misaligning the work port 64 in order to put the flow control valve in the closed state). Accordingly, an output passage 630 is aligned with the drain passage 610 when the drain aperture 605 is aligned with the drain passage 610. The output passage 630 can be fluidly coupled to the reservoir 20, as in this case with the trigger device 601, as the biasing element 70 may not have enough bias force to counteract the pressure of the hydraulic fluid in the common sensing gallery 150. An advantage of using the triggering device 610 in combination with the flow control valve 36 is that the opening of the flow control valve 36 (i.e. shifting of the body 62 against the biasing element 70) will be more of an instantaneous rather than of a graduated affair, as the pressure of the hydraulic fluid entering the control cylinder 61 will be much greater (e.g. one or more orders of magnitude greater) than the biasing strength of the biasing element 70. This is a consequence of the bias strength of the trigger biasing elements 640 (for a respective flow control valve) 36 is set for a higher pressure signal P magnitude than that of the bias strength of the respective biasing element 70 associated with the triggering device 601. In other words, the hydraulic fluid pressure P first shifts trigger body 603 against biasing element 640 in order to open pressure passage 620 for hydraulic fluid to then shift body 60 against the biasing element 70. The benefit of employing the trigger device 601 with the flow control valve 36 is that primarily full flow (e.g. continuous flow) of the hydraulic fluid will occur from the common sensing gallery 150 to the pressure passage 620 with little to no bypass losses through the drain passage 610. It is also recognized that the cross sectional area of passage 260 can be greater than the cross sectional area of passage 620. It is also recognized that the cross sectional area of passage 160 can be greater than the cross sectional area of passage 620. Further, passage 641 can be a machined passage for connected pressure passage 620 with the control cylinder 61.

In terms of the embodiment shown in FIG. 4, for example, for a 5 arrangement hydraulic device 12, a biasing element 640 for the first arrangement would have a biasing strength less than a biasing element 640 for the second arrangement, the biasing element 640 for the second arrangement would have the biasing strength less than a biasing element 640 for the third arrangement, the biasing element 640 for the third arrangement would have the biasing strength less than a biasing element 640 for the fourth arrangement, and the biasing element 640 for the fourth arrangement would have the biasing strength less than a biasing element 640 for the fifth arrangement. In other words, the biasing element 640 for the fifth arrangement would have the strongest bias force and the biasing element 640 for the first arrangement would have the weakest bias force. In this 5 arrangement example, as the pressure signal P increased progressively from a strength only just greater than the biasing force of the first arrangement towards a strength equal to or greater than the biasing force for the fifth arrangement, the hydraulic device 12 would have the first arrangement coupled to the first output port 24 and then iteratively the second arrangement followed by the third arrangement followed by the fourth arrangement followed by the fifth arrangement becoming coupled to the first output port 24 until the hydraulic device 12 had all 5 arrangements combined to pump their respective cylinder 120 volumes to the common first output gallery 240, and thus out of the first output port 24 and to the load 14 via the work leg 16*a*.

Figure 5:
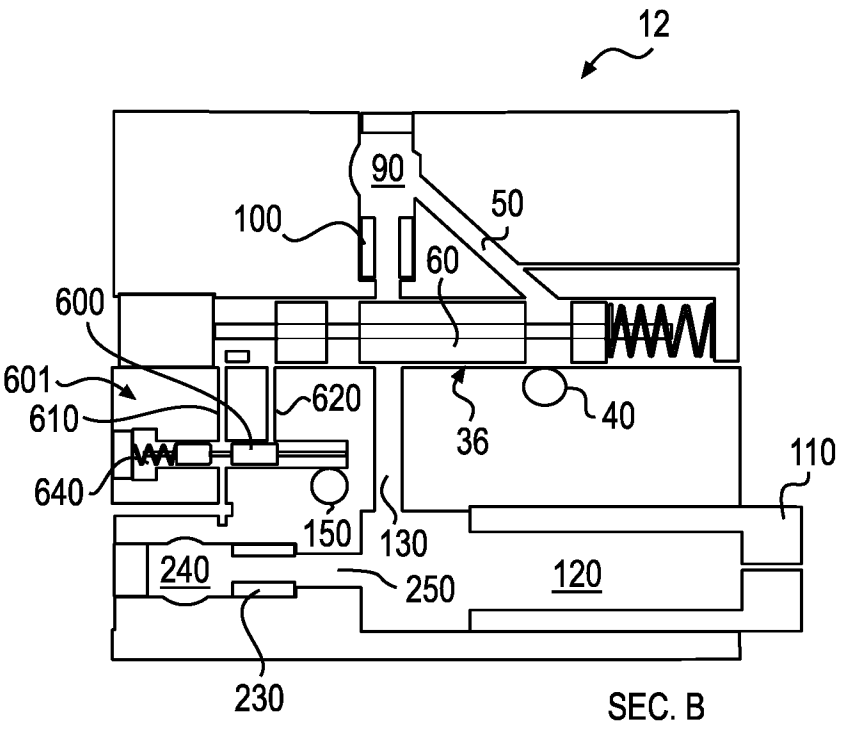
FIG. 5 is a view of the hydraulic device of FIG. 4 with both arrangements in an open mode.
Figure 5:
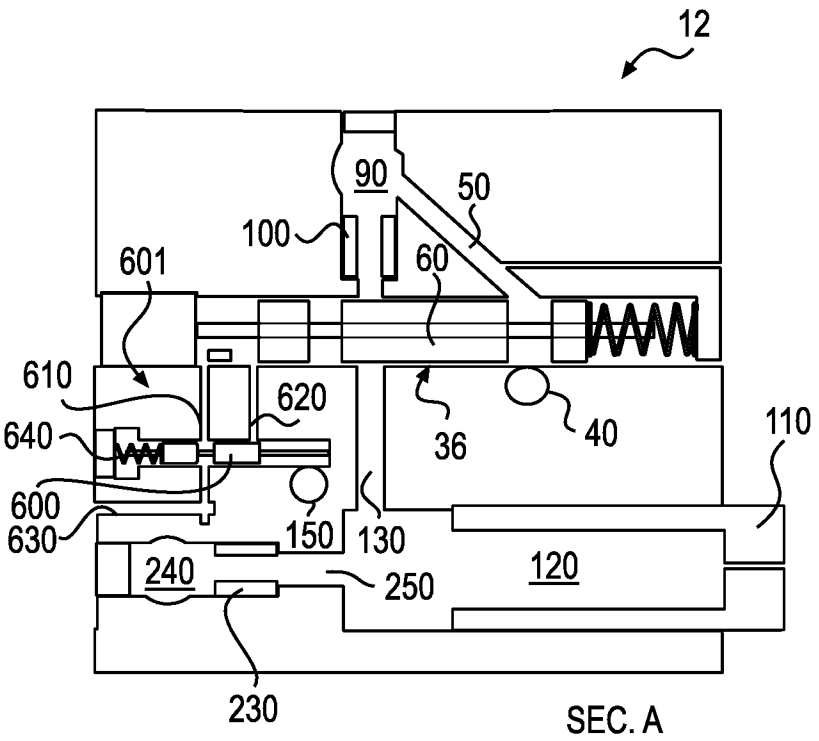

Referring to FIG. 5, shown is a similar mode to that shown in FIG. 3, whereby both of the trigger devices 601 for the pair of arrangements SEC A and SEC B have been forced against the bias of their respective trigger biasing element 640, thus placing (or otherwise maintaining) both of the flow control valves 36 of the arrangements in the open state.

Referring to again to FIG. 4, it is recognized that an alternative embodiment of the trigger device 601 can be such that the element 608 can be an electronically controlled solenoid 608, with the biasing element 640 simply configured as a return spring of the solenoid 608. In this manner, each of the solenoids would be considered collectively as the plurality of "biasing elements 640", such that activation of each of the solenoids 608 would be set for a certain magnitude of the pressure signal P (as an electronic signal supplied by a pressure transducer PD—see FIG. 1). As such, the pressure sensing line 32 can be used to supply both the electronic pressure signal P as well as the portion of the hydraulic fluid used to flow into the control cylinder 61 of the flow control valve 36, as described above. In other words, as the trigger device 601 is electronically activated by the solenoid 608, for a flow control valve 36 in the closed state, the trigger body 603 would be shifted by the solenoid operation in order to block the drain passage 610 and open the pressure passage 620, thus proving for the portion of the hydraulic fluid from the common sensing gallery 150 to enter the control cylinder 61. Similarly, as the solenoid 608 is electronically controlled by the pressure signal P (e.g. in the absence of an electronic signal), for a flow control valve 36 in the open state, the trigger body 603 would be shifted by the solenoid operation in order to open the drain passage 610 and block the pressure passage 620, thus proving for the portion of the hydraulic fluid to exit the control cylinder 61 via the drain passage 630.

Figure 6:
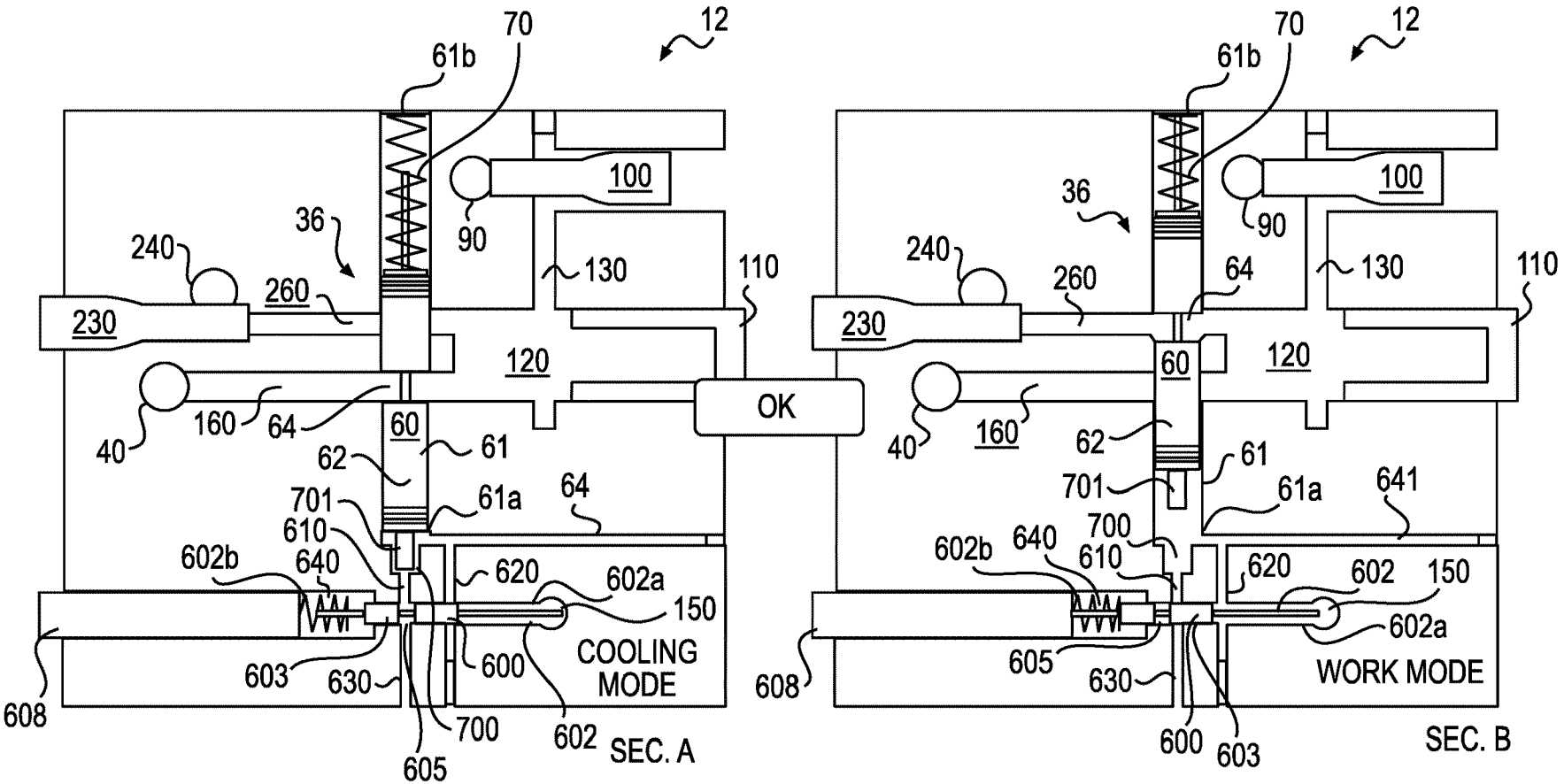
FIG. 6 is a further embodiment of the hydraulic device of FIG. 1 with trigger devices.

Referring to FIG. 6, shown is a further embodiment of the hydraulic device 12, such that that flow control valve 36 is positioned between the cylinder 120 and both of the common first output gallery 240 and the common second output gallery 40. In this case, the optional trigger devices 601 are present. The control valve 36 has the body 62 for reciprocation within the control cylinder 61. Similarly, the body 62 is acted upon by a bias of a biasing element 70 in order to shift the body 62 in the control cylinder 61 towards the end 61*a*. In the event that the trigger device 601 is triggered and allows the portion of the hydraulic fluid from the common sensing gallery 150 to enter the one end 61*a* of the control cylinder 61, then the fluid pressure of the portion of the hydraulic fluid acts against the bias of the biasing element 70 and shifts the body 62 towards the another end 61*b* (see arrangement SEC B of FIG. 6).

In terms of the work port 64 in the body 62 of the flow control valve 36, when the body 62 is under the influence of the bias (i.e. is pushed towards the one end 61*a*), then the work port 64 is aligned with a bypass passage 160 and therefore any output of hydraulic fluid from the cylinder 120 is fluidly communicated to the common second output gallery 40. Further, in this bypass mode (where the flow control valve 36 is in the closed state), the body 62 can block work passage 260 and thus inhibit any flow of hydraulic fluid out of the control cylinder 61 and into the common first output gallery 240 (see arrangement SEC A of FIG. 6).

Figure 8:
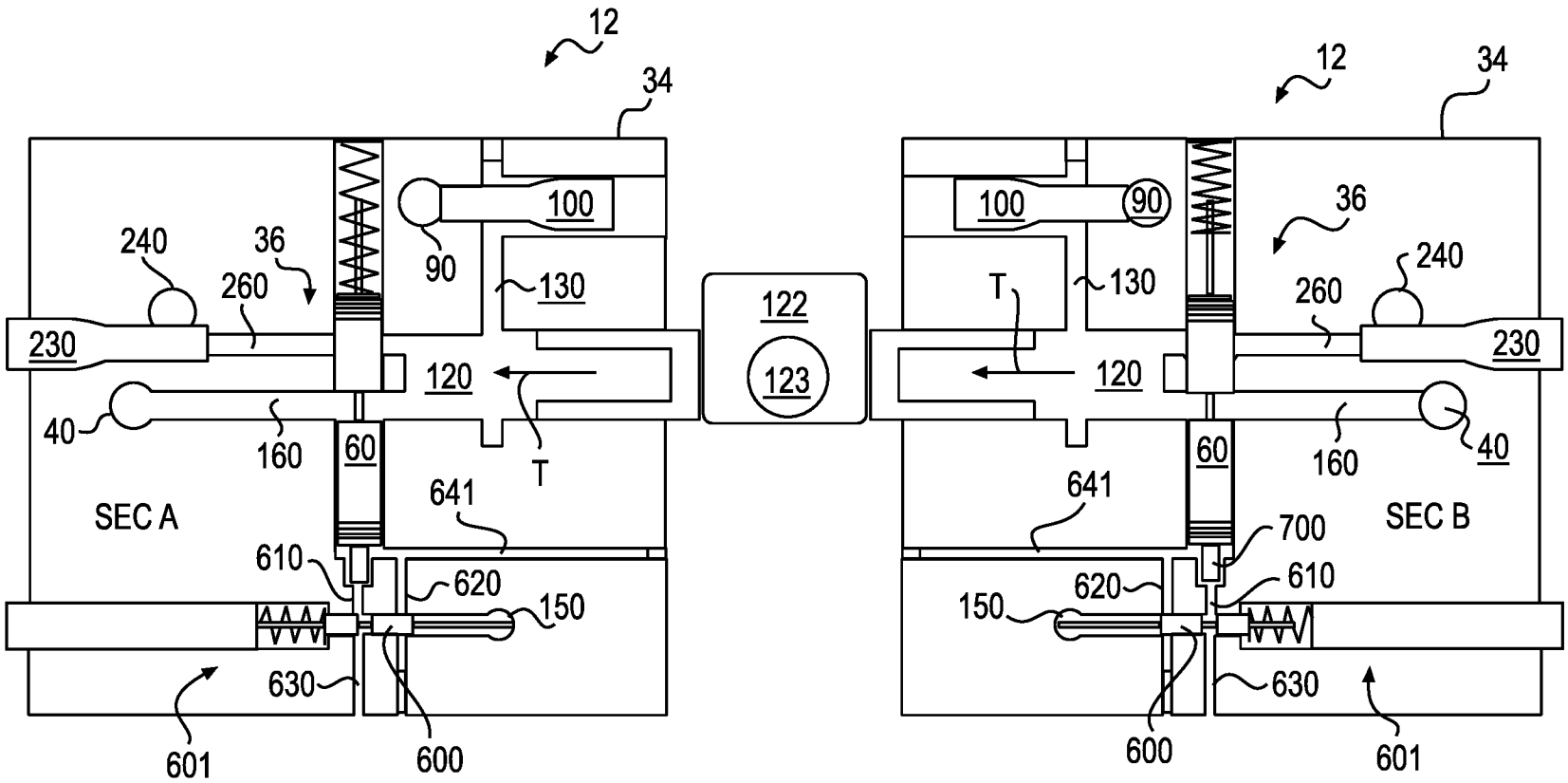
FIG. 8 is a view of the hydraulic device of FIG. 6 with both arrangements in a closed mode.

Referring to FIG. 8, shown is the configuration where a pair of the piston 110—cylinder 120 arrangements are sequentially coupled (e.g. via the motion of the cam 122) to the common second output gallery 40, such that each is associated with their flow control valve 36 in the closed state. For example, the piston 110 of arrangement SEC A is in the process completing its travel T in the cylinder 120 (e.g. travelling towards top dead center towards the bypass passage 160) and thus outputting fluid from its cylinder 120 via bypass passage 160 to the common second output gallery 40. In turn, the piston 110 of arrangement SEC B is in the process of beginning its travel T in the cylinder 120 (e.g. travelling towards bottom dead center away from the bypass passage 160) and thus inputting fluid to its cylinder 120 via bypass passage 160 from the common second output gallery 40. In other words, as both of the pistons 110 of the arrangements SEC A and SEC B are coupled to the motion of the cam 122, the fluid output of one cylinder 120 becomes the fluid input (i.e. is recycled internally within the housing 34) of the another cylinder 120 via the common secondary output gallery 40, for those cylinders 120 in sequence with one another as coupled via the cam 122.

In this manner, it is recognized that as shown in FIG. 1, any hydraulic fluid leaving the hydraulic device 12 can be through the work leg 16*a* of the hydraulic fluid conduits 16 (e.g. via the load 14) or can be through the cooling (also referred to as bypass) leg 16*b* of the hydraulic fluid conduits 16 (e.g. via the heat exchanger 28). In the embodiment shown in FIG. 6, it is further recognized that not all of the fluid entering the common second output gallery 40 would leave the housing 34 via the second output port 26, rather some of the fluid entering the common secondary output gallery 40 would be recycled internally in the housing 34 between sequential piston 110-cylinder 120 arrangements (for those considered in the closed state) via this same common secondary output gallery 40 (see FIG. 8). As discussed above, the heat exchanger 28 can be connected directly between the secondary output port 26 and the input port 22, such that any fluid flowing through the heat exchanger 28 can exit the hydraulic device 12 via the secondary output port 26 and flow directly back to the input port 22 via the bypass leg 16*b* as shown, i.e. in this case bypassing the load 14 as well as bypassing the reservoir 20. Further, it is recognized that the output of the heat exchanger 28 can be dumped directly to the reservoir 20 first (see optional ghosted conduit 16*e*), before being fed back to the input port 22 via the charge pump 30. As before, the pressure relief valve 29 can be connected to the relief line 16*c*, for use when there is a considered oversupply of hydraulic fluid to the hydraulic device 12 (i.e. when the additive flows of fluid from both the heat exchanger 28—as exiting a common secondary output gallery 40, see FIG. 2—combine with the fluid flow from the charge pump 30 as obtained from the reservoir 20).

As discussed above, the flow of hydraulic fluid directed towards the second output port 26, by way of the common second output gallery 40, can exit via the second output port 26 through cooling leg 16*b* (see FIG. 1) and redirected into the common input gallery 90 for subsequent use by any of the piston 110-cylinder 120 arrangements coupled to the motion of the cam 122. For example, for any decoupled piston 110-cylinder 120 arrangements (see arrangement SEC A and SEC B of FIG. 8 having their flow control valves 36 in the closed state), any fluid flowing first in and then out of the common second output gallery 40 would be able to flow in a recycled fashion (internal to the housing 34) via the passage 160 towards the cylinder 120 considered just downstream of the cylinder 120 that just emptied into the common secondary output gallery 40. In other words, referring again to FIG. 8, the arrangement SEC A would first begin/continue discharge of fluid from its cylinder 120 via its passage 160 to the common secondary output gallery 40. Simultaneously, the cylinder 120 of arrangement SEC B (also in the close state) downstream of the arrangement of SEC A would draw fluid from the common secondary output gallery 40, via its passage 160, and thus into its cylinder 120. It is recognized that if the amount of fluid entering the cylinder 120 of arrangement SEC B is less than what is required via movement of the piston 110, fluid can also be inputted into the cylinder 120 of arrangement SEC B via its passage 130 coupled to the common input gallery 90.

In this way, subject to any excessive pressure in the bypass leg 16*b*, any hydraulic fluid exiting (via the common secondary output gallery 40) by the secondary output port 26 would be cooled and thus fed back to the input port 22 (via common input gallery 90) of the hydraulic device 12, recognizing that any hydraulic fluid flowing in the bypass leg 16*b* bypasses the load 14 in when exiting (via the secondary output port 26) and subsequently reentering (via the input port 22) the hydraulic device 12.

In view of the above, it is recognized that any hydraulic fluid flowing between the output port(s) 24,26 and the input port 22 in a path that bypasses the fluid reservoir 20 would be considered as a closed loop operation of the hydraulic device 12. Further, it is recognized that any hydraulic fluid flowing between the output port(s) 24,26 and the input port 22 in a path that goes through the fluid reservoir 20 would be considered as an open loop operation of the hydraulic device 12. Further, it is recognized that any hydraulic fluid flowing between adjacent/sequential arrangements (see FIG. 8) in a path that bypasses the secondary output port 26 altogether (i.e. does not exit the housing 34 and instead is recycled internally) would be considered as a closed loop operation of the hydraulic device 12. Accordingly, it is recognized that, except when the pressure relief valves 29 are utilized, the hydraulic device of FIGS. 1,2 can be operated as a closed loop hydraulic device 12.

Further to the above, it is also recognized that the common input gallery 90 (of the input port 22) of the hydraulic device 12 can be supplied or otherwise supplemented by a combination of fluid flows, i.e. fluid flow from the work leg 16*a* that is leaving the load 14, fluid flow supplied from the reservoir 20 by the charge pump 30, fluid flow from the bypass (or cooling) leg 16*b* exiting the heat exchanger 28 and/or fluid flow that is recycled via the common secondary output gallery 40 for sequential piston 110-cylinder 120 arrangements having their flow control valves 36 in the closed state. An advantage of this multi stream fluid flow to any of the piston 110-cylinder 120 arrangements coupled to the common input gallery 90 is that the charge pump 30 volume output can be reduced, as the flow from the charge pump 30 will be supplemented by the fluid flows exiting the output port(s) 24,26 that bypass the reservoir 20, as described above and shown with reference to FIG. 1, as well as those that are fed recycled fluid via the common secondary output gallery 40 as descried above. In other words, depending upon the configuration of the system 10 (including the pressure and fluid flow demands of the load 14, the size of the charge pump 30 can be reduced and thus provide cost savings for the equipment and operation of the system 10. It is also recognized that there can be more than one charge pump 30, to account for when there is not enough closed loop flow of the fluid to the piston 110-cylinder 120 arrangements via the leg(s) 16*a*,*b* and/or the common secondary output gallery 40, and thus the difference must be made up from that fluid available from the reservoir 20.

Referring again to FIG. 6, the triggering devices 601 function similarly to those described for the hydraulic device 12 embodiment of FIG. 4. In other words, shown is an embodiment of the hydraulic device 12, such that the flow control valve 36 has a trigger device 601. The trigger device 601 is responsible for acting as a trigger for making the respective flow control valve 36 change from a closed state to an open state or from an open state to a closed state. The trigger device 601 has a trigger cylinder 602 with a trigger valve 600 (having a trigger body 603) configured for reciprocation within a trigger cylinder 602. The common sensing gallery 150 is positioned at one end 602*a* of the trigger cylinder 602 and a trigger biasing element 640 is positioned at another end 602*b* of the trigger cylinder 602. The body 603 is positioned between the common sensing gallery 150 and the trigger biasing element 640. In this case, the trigger biasing elements 640 would have the graduated strengths (i.e. different strengths) proportional to the expected pressure rise/decrease of the pressure signal P of the work leg 16*a*. In turn, the biasing elements 70 would be relatively weak (as compared to the trigger biasing elements 640), such that effectively any pressure of the hydraulic fluid allowed to enter the control cylinder 61 by the trigger device 601 would overcome the bias of the biasing element 70 for any of the fluid control valves 36 of the hydraulic device 12. Similarly, in turn, the biasing elements 70 would only be strong enough (as compared to the trigger biasing elements 640), such that any pressure of the hydraulic fluid allowed to leave the control cylinder 61 by the trigger device 601 would facilitate the bias of the biasing element 70 to return any of the fluid control valves 36 of the hydraulic device 12 to their closed state.

In other words, the trigger devices 601 are configured, i.e. the trigger biasing elements 640 are each respectively calibrated for different magnitudes of the pressure signal P, such that if any of them are triggered and thus allow a portion of the hydraulic fluid from the common sensing gallery 150 into the control cylinder 61, then the corresponding flow control valve 36 would change state from the closed state to the open state (i.e. the body 62 would move against the bias of the biasing element 70 and thus cause the work port 64 to become (or otherwise maintain) aligned and the bypass port 63 to become (or otherwise maintain) misaligned—see arrangement SEC B of FIG. 6). Similarly, the trigger devices 601 are configured, such that if any of them are triggered and thus allow the portion of the hydraulic fluid to leave the control cylinder 61 (e.g. to drain back into the common sensing gallery 150 as one embodiment, or to drain back to the reservoir 20 as a second embodiment), then the corresponding flow control valve 36 would change state from the open state to the closed state (i.e. the body 62 would move with the bias of the biasing element 70 and thus cause the work port 64 to become misaligned and the bypass port 63 to become aligned—see arrangement SEC A of FIG. 6).

Accordingly, in the embodiment described in FIG. 6, the biasing elements 640 are of differing strengths (reflective of different magnitudes of the pressure signal P provided by the common sensing gallery 150 during differing operational/load states of the load 14), such that it is recognized that as the magnitude of the pressure signal P increases (say from a lower fluid pressure towards a higher pressure), serially more and more of the biasing elements 640 will be overcome and thus their corresponding flow control valves 36 will change from the closed state to the open state. Similarly, as the biasing elements 640 are of differing strengths (reflective of different magnitudes of the pressure signal P provided by the common sensing gallery 150 during differing operational/load states of the load 14), it is recognized that as the magnitude of the pressure signal P decreases (say from a higher fluid pressure towards a lower pressure), serially more and more of the biasing elements 640 will be released and thus their corresponding flow control valves 36 will change from the open state to the closed state. In this manner, the hydraulic device 12 is operated as a "cylinder on demand" hydraulic device 12, depending upon the states of the respective flow control valves 36 associated with each of the piston 110-cylinder 120 arrangements of the multi-piston 110-cylinder 120 hydraulic device 12. As discussed above, it is recognized that the operation states of the flow control valves 36 are dependent upon the fluid pressure (of the load 14), as sensed via the pressure sending line 32 (reflected by the pressure signal P).

Referring again to FIG. 6, the trigger device 601 of the arrangement SEC B has had the biasing force of the trigger biasing element 640 overcome by the pressure signal P exhibited by the common sensing gallery 150. In other words, the body 603 of the trigger valve 600 has been forced against the bias and towards the another end 602*b*. This has allowed for the portion of the hydraulic fluid to exit the common sensing gallery 150 and enter pressure passage 620 and into the control cylinder 61. As the biasing element 70 of the arrangement SEC B has a relative bias force for the body 62 less than the bias force for the body 603, the body 62 shifts against the bias of the bias element 70 and changes the flow control valve 36 from the closed state to the open state. Referring to arrangement SEC A of FIG. 6, the pressure signal P of the common sensing gallery 150 is not strong enough to overcome the bias of the respective trigger biasing element 640. Thus, a drain port 605 of the body 603 is aligned with a drain passage 610, in order to allow any hydraulic fluid in the control cylinder 61 to leave and thus allow the bias for the biasing element 70 to shift (or otherwise maintain) the body 62 towards the end 61*a* (thereby aligning the bypass port 63 and misaligning the work port 64 in order to put the flow control valve in the closed state). Accordingly, an output passage 630 is aligned with the drain passage 610 when the drain aperture 605 is aligned with the drain passage 610. The output passage 630 can be fluidly coupled to the reservoir 20, as in this case with the trigger device 601, as the biasing element 70 may not have enough bias force to counteract the pressure of the hydraulic fluid in the common sensing gallery 150. An advantage of using the triggering device 610 in combination with the flow control valve 36 is that the opening of the flow control valve 36 (i.e. shifting of the body 62 against the biasing element 70) will be more of an instantaneous rather than of a graduated affair, as the pressure of the hydraulic fluid entering the control cylinder 61 will be much greater (e.g. one or more orders of magnitude greater) than the biasing strength of the biasing element 70. This is a consequence of the bias strength of the trigger biasing elements 640 (for a respective flow control valve) 36 is set for a higher pressure signal P magnitude than that of the bias strength of the respective biasing element 70 associated with the triggering device 601.

In terms of the embodiment shown in FIG. 6, for example, for a 5 arrangement hydraulic device 12, a biasing element 640 for the first arrangement would have a biasing strength less than a biasing element 640 for the second arrangement, the biasing element 640 for the second arrangement would have the biasing strength less than a biasing element 640 for the third arrangement, the biasing element 640 for the third arrangement would have the biasing strength less than a biasing element 640 for the fourth arrangement, and the biasing element 640 for the fourth arrangement would have the biasing strength less than a biasing element 640 for the fifth arrangement. In other words, the biasing element 640 for the fifth arrangement would have the strongest bias force and the biasing element 640 for the first arrangement would have the weakest bias force. In this 5 arrangement example, as the pressure signal P increased progressively from a strength only just greater than the biasing force of the first arrangement towards a strength equal to or greater than the biasing force for the fifth arrangement, the hydraulic device 12 would have the first arrangement coupled to the first output port 24 and then iteratively the second arrangement followed by the third arrangement followed by the fourth arrangement followed by the fifth arrangement becoming coupled to the first output port 24 until the hydraulic device 12 had all 5 arrangements combined to pump their respective cylinder 120 volumes to the common first output gallery 240, and thus out of the first output port 24 and to the load 14 via the work leg 16*a*.

Referring to again to FIG. 6, it is recognized that an alternative embodiment of the trigger device 601 can be such that the element 608 can be an electronically controlled solenoid 608, with the biasing element 640 simply configured as a return spring of the solenoid 608. In this manner, each of the solenoids would be considered collectively as the plurality of "biasing elements 640", such that activation of each of the solenoids 608 would be set for a certain magnitude of the pressure signal P (as an electronic signal supplied by a pressure transducer PD—see FIG. 1). As such, the pressure sensing line 32 can be used to supply both the electronic pressure signal P as well as the portion of the hydraulic fluid used to flow into the control cylinder 61 of the flow control valve 36, as described above. In other words, as the trigger device 601 is electronically activated by the solenoid 608, for a flow control valve 36 in the closed state, the trigger body 603 would be shifted by the solenoid operation in order to block the drain passage 610 and open the pressure passage 620, thus proving for the portion of the hydraulic fluid from the common sensing gallery 150 to enter the control cylinder 61. Similarly, as the solenoid 608 is electronically controlled by the pressure signal P (e.g. in the absence of an electronic signal), for a flow control valve 36 in the open state, the trigger body 603 would be shifted by the solenoid operation in order to open the drain passage 610 and block the pressure passage 620, thus proving for the portion of the hydraulic fluid to exit the control cylinder 61 via the drain passage 630.

An additional component of the triggering device 601 as shown in FIG. 6, over that of FIG. 4, is a stem 701 connected to an end of the body 62 adjacent to the one end 61*a* and a corresponding recess 700 adjacent to an opening of the drain passage 610 connected to the control cylinder 61. As can be seen in the arrangement SEC A, when the body 62 of the flow control valve 36 is in position (as a close state), the stem 701 is received by the recess 700, however the stem 701 is longer than the recess 700 in order to position an end of the body away from the one end 61*a* of the control cylinder 61 (see arrangement SEC A). This spaced apart orientation allows for the portion of the hydraulic fluid from the trigger device 601 (when triggered by an increase in the pressure signal P) to flow into the control cylinder 61 and thus shift the body 62 against the bias of the biasing element 70 (see arrangement SEC A). Further, the positioning of the stem 701 in the recess 700 also blocks the drain passage 610 from any fluid exiting the control cylinder 61 via the input passage 620, until the body 603 of the trigger valve 600 is fully pushed against the bias of the trigger biasing element 640, in order to misalign the drain port 605 and thus block any fluid from flowing out of the control cylinder 61 via the drain passage 610 and output passage 630.

Figure 7:
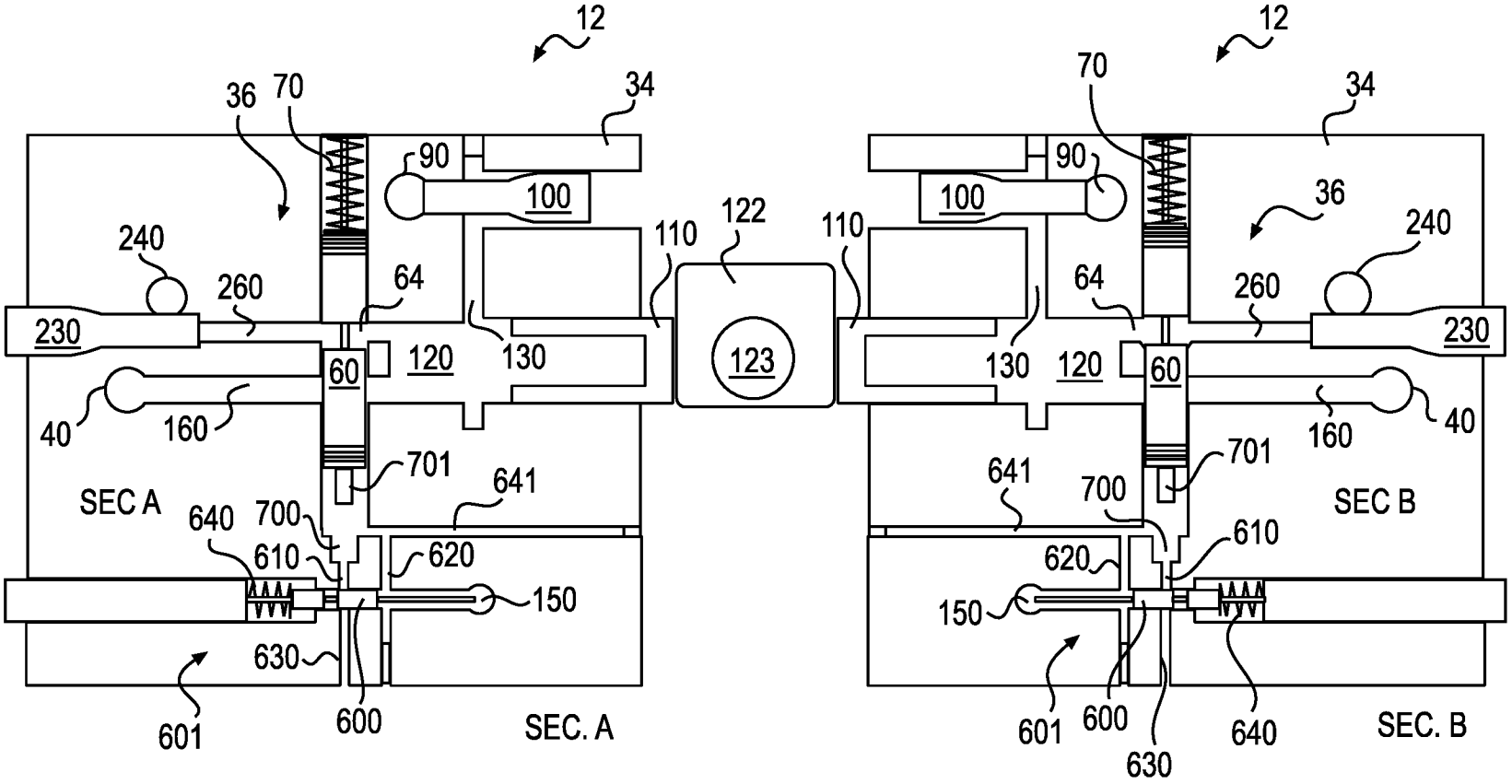
FIG. 7 is a view of the hydraulic device of FIG. 6 with both arrangements in an open mode.

Referring to FIG. 7, shown is a similar mode to that shown in FIG. 5, whereby both of the trigger devices 601 for the pair of arrangements SEC A and SEC B have been forced against the bias of their respective trigger biasing element 640, thus placing (or otherwise maintaining) both of the flow control valves 36 of the arrangements in the open state.

Figure 9:
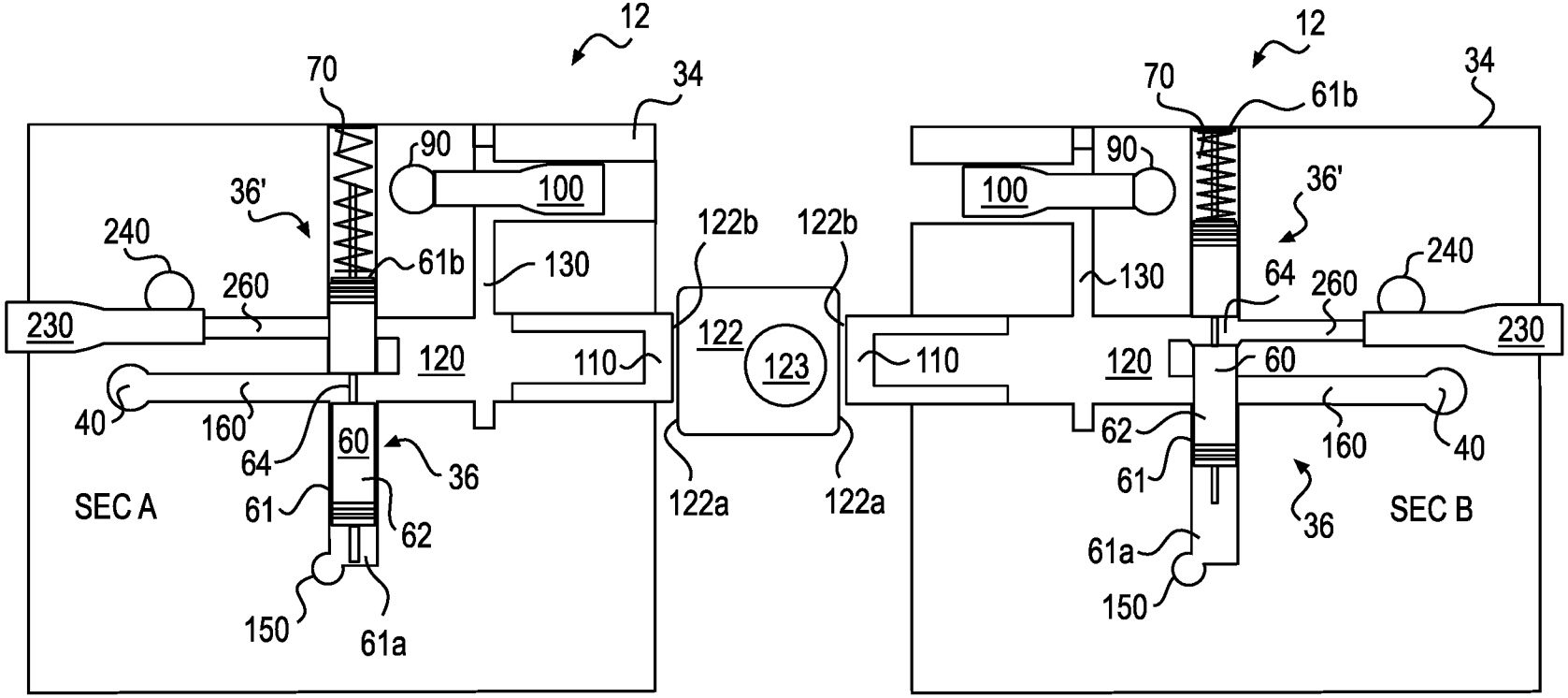
FIG. 9 is a further embodiment of the hydraulic device of FIG. 6 without trigger devices.

Referring to FIGS. 1 and 9, shown is further embodiment of the hydraulic device 12 of FIG. 6 having a plurality of cylinders 120 and corresponding pistons 110. For example, it is envisioned that the hydraulic device 12 can have any number of piston 110—cylinder 120 arrangements, e.g. 5, 7, 9, etc. However for illustration purposes only, a pair of piston 110-cylinder 120 arrangements is shown. The hydraulic device 12 (also referred to as device 12) has the housing 34 for containing the plurality of piston 110-cylinder 120 arrangements, as driven by the cam 122 having a cam surface 122*a* for driving a piston surface 122*b* of the pistons 110 (see FIG. 2 by example for the stated surfaces 122*a,b*). As discussed above, reciprocation of the pistons 110 within their cylinders 120, when driven by the cam 122, will provide for entry of the hydraulic fluid via input passage 130 into the cylinder 120 (volume), and for exit of the hydraulic fluid via output passage(s) 160,260 out of the cylinder 120 (volume).

Further, as by example, each of the output passages 260 is fluidly connected to a first output gallery 240 (e.g. by way of a check valve 230 in order to facilitate a one way flow of hydraulic fluid out of the output passages 260), which is fluidly connected to the first output port 24 (see FIG. 1). As such, each of the piston 110-cylinder 120 arrangements can output their hydraulic fluid to the first output gallery 240 common to all piston 110-cylinder 120 arrangements. Further, as by example, each of the output passages 160 is fluidly connected to a second output gallery 40, which is fluidly connected to the second output port 26 (see FIG. 1). As such, each of the piston 110-cylinder 120 arrangements can output their hydraulic fluid to the second output gallery 40 common to all piston 110-cylinder 120 arrangements.

Further, as by example, each of the input passages 130 is fluidly connected to an input gallery 90 (e.g. by way of a check valve 110 in order to facilitate a one way flow of hydraulic fluid into the input passages 130), which is fluidly connected to the input port 22 (see FIG. 1). As such, each of the piston 110-cylinder 120 arrangements can have their hydraulic fluid input from the input gallery 90 common to all piston 110-cylinder 120 arrangements. As discussed above, it is also recognized that each of the cylinders 120 (when their flow control valve 36 is in the closed state) can also be supplied fluid from the common secondary output gallery 40 (for when recycling of fluid via the common secondary output gallery 40 is enabled as discussed by example with reference to FIG. 11). It is recognized that any fluid flowing through passage 160 towards the cylinder 120 would be subsequently received by the cylinder 120. Similarly, it is recognized that any fluid flowing through passage 160 away from the cylinder 120 would be subsequently received by the common secondary output gallery 40.

It is recognized that any fluid flowing through input passage 130 would be subsequently received by the cylinder 120. Similarly, it is recognized that any fluid flowing through the output passage 260 would be subsequently received by the common first output gallery 240. Further, the common input gallery 90 can also be fluidly connected by respective bypass passages 160 to the bypass gallery 40 (i.e. the common secondary output gallery 40) that is commonly associated with all of the piston 110-cylinder 120 arrangements.

A flow control valve 36 (for each piston 110-cylinder 120 arrangement) can be positioned between the piston 110-cylinder 120 arrangement (across bypass passage 160 and output passage 260) and the common bypass gallery 40. As further described below, depending upon the operational state of the flow control valve 36 (e.g. an open state or a closed state), the flow control valve 36 can: 1) inhibit flow of the hydraulic fluid between piston 110-cylinder 120 arrangement and the first output gallery 240; 2) allow flow of the hydraulic fluid between common input gallery 90 and the first output gallery 240 (i.e. by way of the piston 110-cylinder 120 arrangement); 3) inhibit flow of the hydraulic fluid between the piston 110-cylinder 120 arrangement and the second output gallery 40 (i.e. by way of the bypass passage 160); and 4) allow flow of the hydraulic fluid between the piston 110-cylinder 120 arrangement and the second output gallery 40 (i.e. by way of the bypass passage 160).

In FIG. 9, by example, the flow control valve 36 associated with the piston 110—cylinder 120 arrangement labelled SEC A would be considered in the closed state. The valve components 36' (described by example above) of the flow control valve 36 are blocking flow of the fluid between the cylinder 120 and the common first output gallery 240 and (e.g. blocking passage 260), while allowing the flow of fluid between the cylinder 120 and the common second output gallery 40 (e.g. via open bypass passage 160). Accordingly, as shown by example for the hydraulic device 12 embodiment of FIG. 9, during cyclic operation of the cam 122, the arrangement SEC A is configured by the closed state of its respective flow control valve 36 to send fluid from the common input gallery 90 directly to the common bypass gallery 40. Thus the arrangement SEC A does not send fluid out of the first output port 24 while the cam 122 rotates, rather any fluid input to the arrangement SEC A flows straight to the second common output gallery 40. As further described, any fluid entering the common second output gallery 40 can be directed within the housing 34 (e.g. by the second common output gallery 40) back to a downstream cylinder 120, for use by other piston 110-cylinder 120 arrangements (e.g. arrangement SEC B—see FIG. 8). Alternatively, or in addition to, any fluid entering the common second output gallery 40 can be delivered to the second output port 26 for delivery to the heat exchanger 28 via the hydraulic fluid conduits of leg 16*b*—see FIG. 1.

In FIG. 9, the flow control valve 36 associated with the piston 110-cylinder 120 arrangement labelled SEC B would be considered in the open state. The valve components 36' (described by example above) of the flow control valve 36 are allowing flow of the fluid between the common first output gallery 240 and the cylinder 120 (e.g. via open passage 260), while blocking the flow of fluid between the cylinder 120 and the common second output gallery 40 (e.g. blocking bypass passage 160). Accordingly, as shown by example for the hydraulic device 12 embodiment of FIG. 9, during cyclic operation of the cam 122, the arrangement SEC B is configured by the open state of its respective flow control valve 36 to send fluid from the common input gallery 90 to the common first output gallery 240 by way the input passage 130 and the passage 260. Thus the arrangement SEC B does send fluid out of the first output port 24, while the cam 122 rotates, and thus powers or otherwise hydraulically drives the load 14. In other words, arrangement SEC B of FIG. 9, as it is in the open state, would be considered as one of the arrangements of the hydraulic device 12 that is a cylinder 120 "in demand". Similarly, arrangement SEC A of FIG. 9, as it is in the closed state, would be considered as one of the arrangements of the hydraulic device 12 that is a cylinder 120 not "in demand".

Thus, as described above, the hydraulic device 12 embodiment shown in FIG. 9 would have only one piston 110-cylinder 120 arrangement SEC B supplying the load 14 (see FIG. 1) via the first output port 24 (i.e. the flow control valve 36 associated with the arrangement SEC B is in the open state). As discussed, the piston 110-cylinder 120 arrangement SEC A would be inhibited from supplying the first output port 24 by the respective flow control valve 36 (in the closed state) associated with the arrangement SEC A. In other words, the passages 130,260 of arrangement SEC A are inhibited from supplying fluid from the common input gallery 90 to the common first output gallery 240, while the input passages 130,160 of arrangement SEC B are allowed to supply fluid from the common input gallery 90 to the common first output gallery 240, thus configuring the hydraulic device 12 as having only one of a pair of piston 110-cylinder 120 arrangements (i.e. SEC A and SEC B) supplying output hydraulic fluid to the first output port 24 (which subsequently supplies the load 14 via the work leg 16*a* of the hydraulic fluid conduits 16). As shown in FIG. 9, the piston 110 of the arrangement SEC A is coupled to the cam 122, i.e. piston surface 122*b* and cam surface 122*a* are in contact with one another and as such the piston 110 of arrangement SEC A does reciprocate within its cylinder 120, however its cylinder output is directed to the common secondary output gallery 40. Further, the piston 110 of the arrangement SEC B is coupled to the cam 122, i.e. piston surface 122*b* and cam surface 122*a* are in contact with one another and as such the piston 110 of arrangement SEC B does reciprocate within its cylinder 120, however its cylinder output is directed to the common first output gallery 240.

Figure 10:
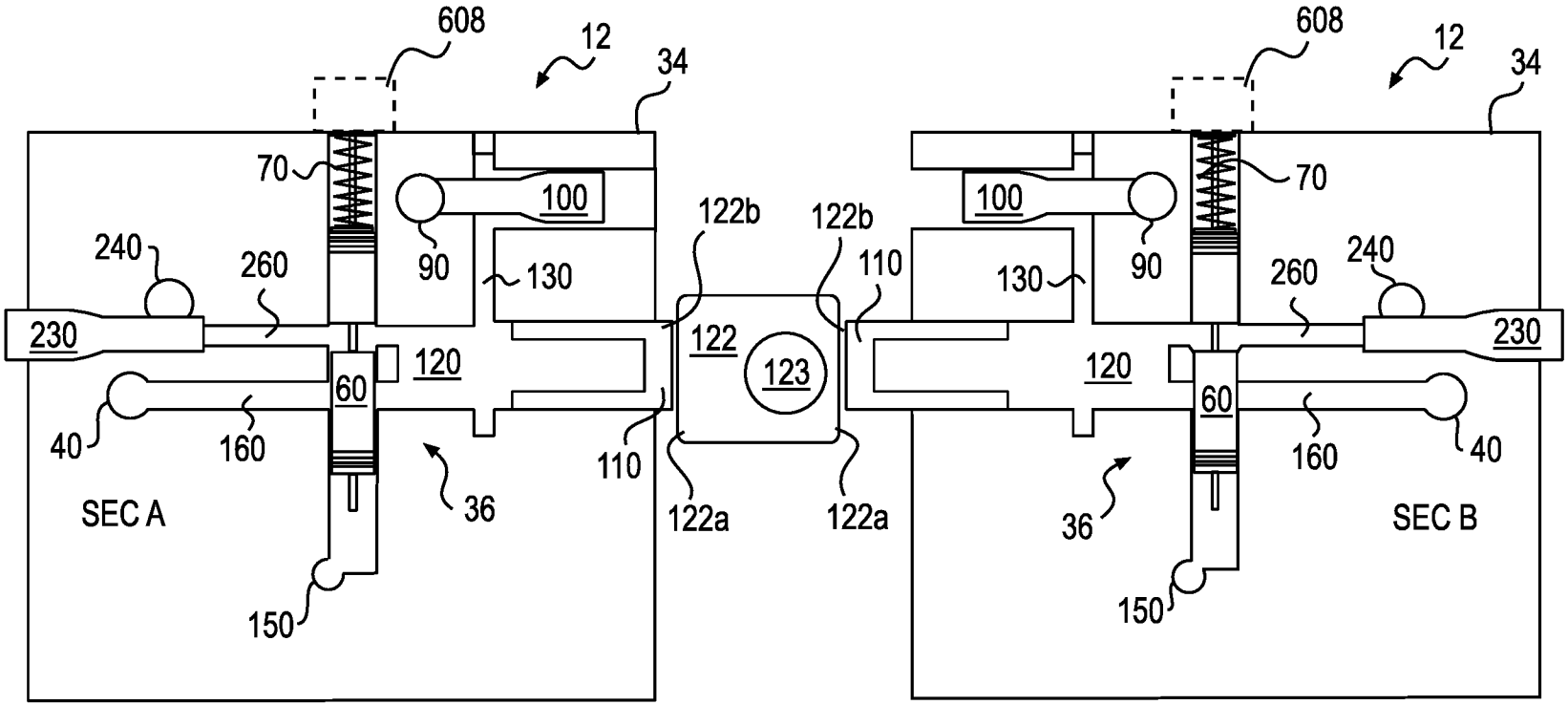
FIG. 10 is a view of the hydraulic device of FIG. 9 with both arrangements in an open mode.

Referring to FIG. 10, shown is a further operational mode of the hydraulic device of FIG. 9, such that both the arrangement SEC A and the arrangement SEC B are supplying hydraulic fluid to the first output port 24 (see FIG. 1), in view of the flow control valve 36 of the arrangement SEC A is in the open state, as is the flow control valve 36 of the arrangement SEC B. Accordingly, it is recognized that in the operational mode of FIG. 10 provides double the flow of hydraulic fluid out of the first output port 24, as compared to the operational mode shown in FIG. 9.

In view of FIGS. 9 and 10, these can be used to describe two different case scenarios. The first case scenario is where the hydraulic device 12 is operating at a reduced output mode (as shown by FIG. 9) and then the hydraulic device 12 gets a pressure signal P (via fluid pressure sensing line—see FIG. 1) that changes the state of the flow control valve 36 of arrangement SEC A from the closed state to the open state. Once that change of state occurs, then the hydraulic fluid would flow via input passage 130 of arrangement SEC A into the corresponding cylinder 120 and then out of the passage 260 into the common first output gallery 240. Fluid filling the cylinder 120 of arrangement SEC A would push the corresponding pistons 110 against the cam surfaces 122*a* of cam 122, in order for both the pistons 110 of the arrangements SEC A and SEC B to reciprocate as directed by the rotating cam 122. This would, in effect transform the operational mode of the hydraulic device 12 from that shown in FIG. 9 to that shown in FIG. 10. Accordingly, the receipt of the pressure signal P, and resulting change in state of the flow control valve 36 of arrangement SEC A, provides for an increase in volume output of fluid via the first output port 24, as the flow of fluid from arrangement SEC A is now joined to that of the flow of fluid from arrangement SEC B to the common first output gallery 240. The second case scenario is where the hydraulic device 12 is operating at an increased output mode (as shown by FIG. 10) and then the hydraulic device 12 gets the pressure signal P (via fluid pressure sensing line 32—see FIG. 1) that changes the state of the flow control valve 36 of arrangement SEC A from the open state to the closed state. Once that change of state occurs, then the hydraulic fluid would flow via bypass passage 160 (instead of passage 260) of arrangement SEC A into the corresponding common second output gallery 40.

This would, in effect transform the operational mode of the hydraulic device 12 from that shown in FIG. 10 to that shown in FIG. 9. Accordingly, the receipt of the pressure signal P, and resulting change in state of the flow control valve 36 of arrangement SEC A, provides for a decrease in volume output of fluid via the first output port 24. It is recognized that for a multi piston 110-cylinder 120 arrangement hydraulic device 12 (i.e. having more than 2 piston 110-cylinder 120 arrangements) the number of piston 110—cylinder 120 arrangements operating (i.e. coupled to the cam 122 and thus their output connected to the common first output gallery 240) or inactive (i.e. also coupled to the cam 122 while their output connected to the common second output gallery 40) can be two or more, depending upon the number of piston 110-cylinder 120 arrangements available. For an example 5 arrangement hydraulic device 12 (e.g. 2 arrangements outputting to common first output gallery 240 and 3 arrangements outputting to common second output gallery 40, 1 arrangement outputting to common first output gallery 240 and 4 arrangements outputting to common second output gallery 40, 5 arrangements outputting to common first output gallery 240 and 0 arrangements outputting to common second output gallery 40, etc.). Depending upon the pressure signal P, respective ones of the arrangements can be either coupled to the common first output gallery 240 (thus directing output to the first output port 24) or coupled to the common second output gallery 40 (thus directing output towards the second output port 26 or recycling between sequential cylinders 120 via the common second output gallery 40).

Figure 11:
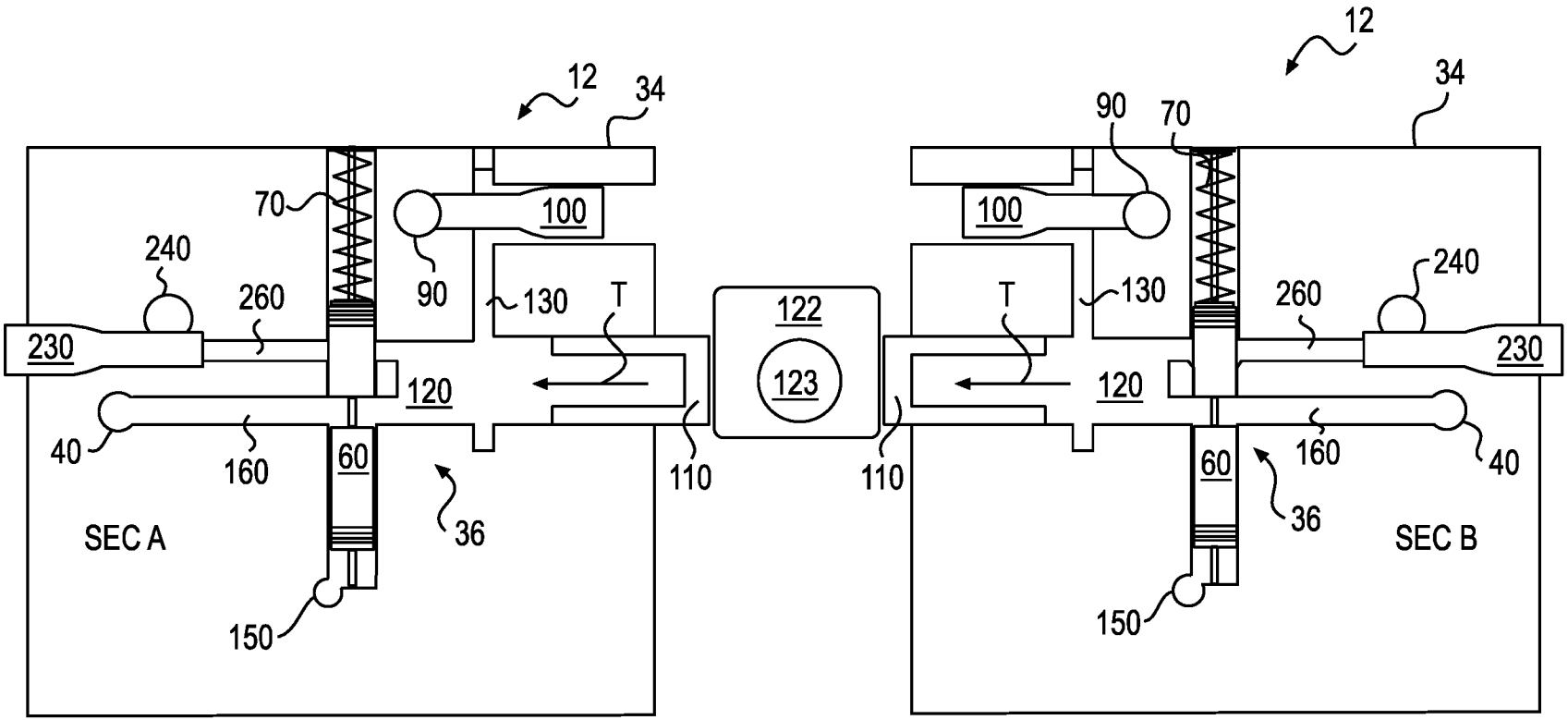
FIG. 11 is a view of the hydraulic device of FIG. 9 with both arrangements in a closed mode.

Referring to FIG. 11, shown is the configuration where a pair of the piston 110—cylinder 120 arrangements are sequentially coupled (e.g. via the motion of the cam 122) to the common second output gallery 40, such that each is associated with their flow control valve 36 in the closed state. For example, the piston 110 of arrangement SEC A is in the process completing its travel T in the cylinder 120 (e.g. travelling towards top dead center towards the bypass passage 160) and thus outputting fluid from its cylinder 120 via bypass passage 160 to the common second output gallery 40. In turn, the piston 110 of arrangement SEC B is in the process of beginning its travel T in the cylinder 120 (e.g. travelling towards bottom dead center away from the bypass passage 160) and thus inputting fluid to its cylinder 120 via bypass passage 160 from the common second output gallery 40. In other words, as both of the pistons 110 of the arrangements SEC A and SEC B are coupled to the motion of the cam 122, the fluid output of one cylinder 120 becomes the fluid input (i.e. is recycled internally within the housing 34) of the another cylinder 120 via the common secondary output gallery 40, for those cylinders 120 in sequence with one another as coupled via the cam 122.

In this manner, it is recognized that as shown in FIG. 1, any hydraulic fluid leaving the hydraulic device 12 can be through the work leg 16*a* of the hydraulic fluid conduits 16 (e.g. via the load 14) or can be through the cooling (also referred to as bypass) leg 16*b* of the hydraulic fluid conduits 16 (e.g. via the heat exchanger 28). In the embodiment shown in FIG. 9, it is further recognized that not all of the fluid entering the common second output gallery 40 would leave the housing 34 via the second output port 26, rather some of the fluid entering the common secondary output gallery 40 would be recycled internally in the housing 34 between sequential piston 110-cylinder 120 arrangements (for those considered in the closed state) via this same common secondary output gallery 40 (see FIG. 11). As discussed above, the heat exchanger 28 can be connected directly between the secondary output port 26 and the input port 22, such that any fluid flowing through the heat exchanger 28 can exit the hydraulic device 12 via the secondary output port 26 and flow directly back to the input port 22 via the bypass leg 16*b* as shown, i.e. in this case bypassing the load 14 as well as bypassing the reservoir 20. Further, it is recognized that the output of the heat exchanger 28 can be dumped directly to the reservoir 20 first (see optional ghosted conduit 16*e*), before being fed back to the input port 22 via the charge pump 30. As before, the pressure relief valve 29 can be connected to the relief line 16*c*, for use when there is a considered oversupply of hydraulic fluid to the hydraulic device 12 (i.e. when the additive flows of fluid from both the heat exchanger 28—as exiting a common secondary output gallery 40, see FIG. 9—combine with the fluid flow from the charge pump 30 as obtained from the reservoir 20).

As discussed above, the flow of hydraulic fluid directed towards the second output port 26, by way of the common second output gallery 40, can exit via the second output port 26 through cooling leg 16*b* (see FIG. 1) and redirected into the common input gallery 90 for subsequent use by any of the piston 110-cylinder 120 arrangements coupled to the motion of the cam 122. For example, for any coupled piston 110-cylinder 120 arrangements (see arrangement SEC A and SEC B of FIG. 9,11 having their flow control valves 34 in the closed state), any fluid flowing first in and then out of the common second output gallery 40 would be able to flow in a recycled fashion (internal to the housing 34) via the passage 160 towards the cylinder 120 considered just downstream of the cylinder 120 that just emptied into the common secondary output gallery 40. In other words, referring again to FIG. 11, the arrangement SEC A would first begin/continue discharge of fluid from its cylinder 120 via its passage 160 to the common secondary output gallery 40. Simultaneously, the cylinder 120 of arrangement SEC B (also in the close state) downstream of the arrangement of SEC A would draw fluid from the common secondary output gallery 40, via its passage 160, and thus into its cylinder 120. It is recognized that if the amount of fluid entering the cylinder 120 of arrangement SEC B is less than what is required via movement of the piston 110, fluid can also be inputted into the cylinder 120 of arrangement SEC B via its passage 130 coupled to the common input gallery 90.

In this way, subject to any excessive pressure in the bypass leg 16*b*, any hydraulic fluid exiting (via the common secondary output gallery 40) by the secondary output port 26 would be cooled and thus fed back to the input port 22 (via common input gallery 90) of the hydraulic device 12, recognizing that any hydraulic fluid flowing in the bypass leg 16*b* bypasses the load 14 in when exiting (via the secondary output port 26) and subsequently reentering (via the input port 22) the hydraulic device 12.

In view of the above, it is recognized that any hydraulic fluid flowing between the output port(s) 24, 26 and the input port 22 in a path that bypasses the fluid reservoir 20 would be considered as a closed loop operation of the hydraulic device 12. Further, it is recognized that any hydraulic fluid flowing between the output port(s) 24, 26 and the input port 22 in a path that goes through the fluid reservoir 20 would be considered as an open loop operation of the hydraulic device 12. Further, it is recognized that any hydraulic fluid flowing between adjacent/sequential arrangements (see FIG. 11) in a path that bypasses the secondary output port 26 altogether (i.e. does not exit the housing 34 and instead is recycled internally) would be considered as a closed loop operation of the hydraulic device 12. Accordingly, it is recognized that, except when the pressure relief valves 29 are utilized, the hydraulic device of FIGS. 1, 9,10,11 can be operated as a closed loop hydraulic device 12.

Further to the above, it is also recognized that the common input gallery 90 (of the input port 22) of the hydraulic device 12 can be supplied or otherwise supplemented by a combination of fluid flows, i.e. fluid flow from the work leg 16*a* that is leaving the load 14, fluid flow supplied from the reservoir 20 by the charge pump 30, fluid flow from the bypass (or cooling) leg 16*b* exiting the heat exchanger 28 and/or fluid flow that is recycled via the common secondary output gallery 40 for sequential piston 110-cylinder 120 arrangements having their flow control valves 36 in the closed state. An advantage of this multi stream fluid flow to any of the piston 110-cylinder 120 arrangements coupled to the common input gallery 90 is that the charge pump 30 volume output can be reduced, as the flow from the charge pump 30 will be supplemented by the fluid flows exiting the output port(s) 24, 26 that bypass the reservoir 20, as described above and shown with reference to FIG. 1, as well as those that are fed recycled fluid via the common secondary output gallery 40 as descried above. In other words, depending upon the configuration of the system 10 (including the pressure and fluid flow demands of the load 14, the size of the charge pump 30 can be reduced and thus provide cost savings for the equipment and operation of the system 10. It is also recognized that there can be more than one charge pump 30, to account for when there is not enough closed loop flow of the fluid to the piston 110-cylinder 120 arrangements via the leg(s) 16*a,b* and/or the common secondary output gallery 40, and thus the difference must be made up from that fluid available from the reservoir 20.

Referring again to FIGS. 1 and 9, the operation of the flow control valves 36 is now described, in view of the sensed pressure signal P received via the pressure sensing line 32.

One embodiment of the flow control valve 36 is as a spool valve, such that the valve components 36' include a control cylinder 61 having a shuttle valve 60 having a body 62. The shuttle valve 60 is configured to reciprocate within the control cylinder 61, dependent upon a pressure signal P available at common sensing gallery 150, which is fluidly connected to the work leg 16*a* (between the load 14 and the first output port 24) by pressure sensing line 32—see FIG. 1. The body 62 is also biased by biasing element 70 in order to block any of the passages 160, 260 (thus providing either a closed state or an open state respectively of the flow control valve 36). The body 62 has a work port 64, such that the common input gallery 90 is fluidly coupled to the common second output gallery 40 when the work port 64 is aligned with the bypass passage 160—see arrangement SEC A of FIG. 9. Further, when the work port 64 is aligned with the bypass passage 160, then the work port 64 is misaligned with the passage 260 and therefore the common input gallery 90 is fluidly blocked from fluid communication with the common first output gallery 240 (via the reciprocating piston 110—cylinder 120 arrangement)—see arrangement SEC A. Alternatively, the body 62 has the work port 64, such that the common input gallery 90 is fluidly blocked from the common second output gallery 40 when the work port 64 is misaligned with the bypass passage 160 and therefore aligned with the passage 260—see arrangement SEC B of FIG. 9. Further, when the work port 64 is misaligned with the bypass passage 160, then the work port 64 is aligned with the input passage 260 and therefore the common input gallery 90 is fluidly coupled for fluid communication with the common first output gallery 240 (via the reciprocating piston 110-cylinder 120 arrangement)—see arrangement SEC B. When the passage 160,260 is blocked, it is the body 62 of the flow control valve 36 that inhibits fluid communication between the cylinder 120 and the respective common output gallery 40,240.

In terms of how the port 64 switches between aligned and misaligned with respect to the passages 160,260, this depends upon the strength of the pressure signal P in view of the strength of the bias exerted by the biasing element 70, as provided by a pressure sensing device 151 (see FIG. 1). In a first embodiment, the pressure sensing device 151 can be provided hydraulically, such that the pressure sensing device 151 includes the pressure sensing line 32 connected between the work leg 16*a* and the common sensing gallery 150. As such, the hydraulic fluid from the work leg 16*a* (as positioned between the load 14 and the first output port 24) would pressurize the pressure sensing line 32 and fill the common sensing gallery 150. If the magnitude of the pressure of the hydraulic fluid on the common sensing gallery 150 is greater than the magnitude of the bias provided by the biasing element 70, the body 62 would shift in the control cylinder 61 against the bias and thus allow a portion of the fluid from the common sensing gallery 150 (as obtained from the work leg 16*a*) to fill the control cylinder 61 until the port 64 switches and becomes aligned with the passage 260 (and thus the body 62 blocks the passage 160).

For example, if the pressure signal P at the common sensing gallery 150 is greater than the strength of the biasing element 70 for the flow control valve 36, then the body 62 would be forced against the bias of the biasing element 70 and this would result in a shift of the body 62 within the control cylinder 61 in a direction towards the biasing element 70. If the magnitude of the pressure signal P is large enough to overcome the bias exerted by the biasing element 70, then the body 62 would shift in the control cylinder 61 such that the work port 64 would become aligned with the passage 260 and would become misaligned with the bypass passage 160 (see SEC B of FIG. 2). Referring further to FIG. 9, the same pressure signal P (experienced by the arrangement SEC B) is also present at the common sensing gallery 150 for the control cylinder 61 of the arrangement SEC A. In this case, the magnitude of the pressure signal P is less than the bias exerted by the biasing element 70 on the body 62 of the arrangement SEC A, and as such the body 62 remains shifted in the control cylinder 61 away from the biasing element 70 and towards the common sensing gallery 150. In this biased position for the arrangement SEC A, the work port 64 is (e.g. remains/becomes) misaligned with the passage 260 and is (e.g. remains/becomes) aligned with the bypass passage 160. In terms of the pair of biasing elements 70 shown in FIG. 9, the biasing element 70 of arrangement SEC A can be of a stronger magnitude (i.e. stronger biasing force) than the biasing element 70 of arrangement SEC B. In other words, each of the plurality of biasing elements for the respective piston 110-cylinder 120 arrangements (of the hydraulic device 12) would have different biasing strengths. In this example, the operation of the flow control valves 36 is coordinated without use of triggering devices 601 (further described above).

Accordingly, in the embodiment described in FIG. 9, the biasing elements 70 are of differing strengths (reflective of different magnitudes of the pressure signal P provided by the common sensing gallery 150 during differing operational/load states of the load 14), such that it is recognized that as the magnitude of the pressure signal P increases (say from a lower fluid pressure towards a higher pressure), serially more and more of the biasing elements 70 will be overcome and thus their corresponding flow control valves 36 will change from the closed state to the open state. Similarly, as the biasing elements 70 are of differing strengths (reflective of different magnitudes of the pressure signal P provided by the common sensing gallery 150 during differing operational/load states of the load 14), it is recognized that as the magnitude of the pressure signal P decreases (say from a higher fluid pressure towards a lower pressure), serially more and more of the biasing elements 70 will be released and thus their corresponding flow control valves 36 will change from the open state to the closed state. In this manner, the hydraulic device 12 is operated as a "cylinder on demand" hydraulic device 12, depending upon the states of the respective flow control valves 36 associated with each of the piston 110-cylinder 120 arrangements of the multi-piston 110—cylinder 120 hydraulic device 12. As discussed above, it is recognized that the operation states of the flow control valves 36 are dependent upon the fluid pressure (of the load 14), as sensed via the pressure sending line 32 (reflected by the pressure signal P).

For example, for a 5 arrangement hydraulic device 12, a biasing element 70 for the first arrangement would have a biasing strength less than a biasing element 70 for the second arrangement, the biasing element 70 for the second arrangement would have the biasing strength less than a biasing element 70 for the third arrangement, the biasing element 70 for the third arrangement would have the biasing strength less than a biasing element 70 for the fourth arrangement, and the biasing element 70 for the fourth arrangement would have the biasing strength less than a biasing element 70 for the fifth arrangement. In other words, the biasing element 70 for the fifth arrangement would have the strongest bias force and the biasing element 70 for the first arrangement would have the weakest bias force. In this 5 arrangement example, the as the pressure signal P increased progressively from a strength only just greater than the biasing force of the first arrangement towards a strength equal to or greater than the biasing force for the fifth arrangement, the hydraulic device 12 would have the first arrangement coupled to the first output port 24 and then iteratively the second arrangement followed by the third arrangement followed by the fourth arrangement followed by the fifth arrangement becoming coupled to the first output port 24 until the hydraulic device 12 had all 5 arrangements combined to pump their respective cylinder 120 volumes to the common first output gallery 240, and thus out of the first output port 24 and to the load 14 via the work leg 16*a*. In other words, each of the piston 110-cylinders 120 would become "on demand", as their respective flow control valves 36 changed from the closed state to the open state.

For the operation of the flow control valves 36, in terms of the body 62 of the control valve 60 shifting back towards the common sensing gallery 150, as the magnitude of the pressure signal P drops, any fluid present in the control cylinder 61 (used in the earlier displacement of the body 62 against the bias of the biasing element 70) would be forced to return to the common sensing gallery 150 and ultimately back into the work leg 16*a* via the pressure sensing line 32. This return of the fluid back into the common sensing gallery 150 would be caused by the bias of the biasing element 70 overcoming the relatively weaker pressure (i.e. reflective of pressure signal P) of the hydraulic fluid in the control cylinder 61.

Referring again to FIG. 9, as one embodiment of the flow control valve, the control cylinder 61 has one end 61*a* having the common sensing gallery 150 and another end 61*b* having the biasing element 70, such that the body 62 is positioned in the control cylinder 61 between the common sensing gallery 150 and the biasing element 70.

It is recognized as a clear advantage, e.g. in hydraulic device 12 configuration complexity and/or cost (e.g. manufacturing and/or maintenance), that the fluid pressure sensing device 151 is driven by directly sensing the fluid pressure itself, as generated by operation of the load 14. This direct sensing of the actual fluid pressure in the work leg 16*a* is considered preferential over any other type of non-fluid based measurement (e.g. torque). In particular, the response time of needed changes to the flow output via the output port 24 and/or output port 26 (as dictated by the opening/closing of respective ones (or multiples) of the flow control valves 36) is considered best when the actual fluid pressure of the work leg 16*a* is sensed (i.e. via fluid pressure sensing line 32), rather than introducing undesirable time lag into the control of the output flow of the hydraulic device 12 operation when using non-fluid based sensing systems. Clearly, it is the ability of the fluid pressure sensing line 32 being directly coupled to the work leg 16*a*, between the load 14 and the output port 24, that contributes to desired advantages of using the invention as described and claimed herein.

Figure 12:
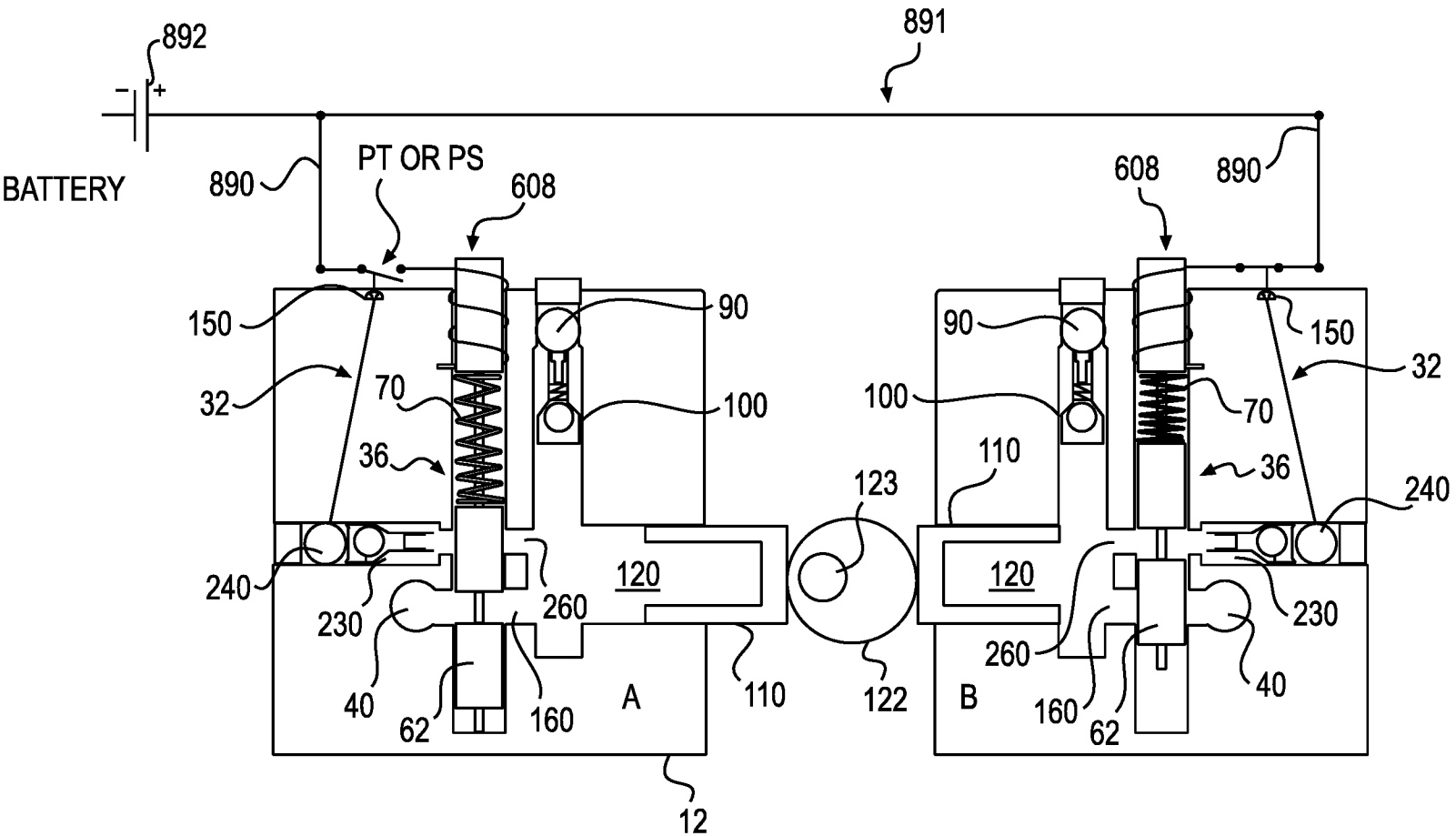
FIG. 12 is a further embodiment of the flow control valve of any of FIGS. 2-11.

Referring to FIG. 12, shown is an example embodiment of the system 10 of FIG. 1. In particular, shown is the hydraulic device 12 having arrangement SEC A with the flow control valve 36 in the closed position and the arrangement SEC B with the flow control valve 36 in the open position. As such, any fluid entering the input gallery 90 of arrangement SEC B will be directed by the reciprocation of its piston 110 via the flow control valve 36 into the first output gallery 240. As such, any fluid entering the input gallery 90 of arrangement SEC A with be directed by the reciprocation of its piston 110 via the flow control valve 36 into the second output gallery 40. In terms of operation of the flow control valves 36, the solenoids 608 are connected to a control circuit 891 having a battery 892 and electrical connections 890 to the battery 892. Also, the control circuit 891 includes the pressure transducers PT or pressure switches PS, which are part of the pressure sensing line 32 coupled to the common sensing gallery 150 (see FIG. 1 also by example). As an embodiment, the control circuit 891 can be considered as part of the fluid pressure sensing device 151 (see FIG. 1).

Upon activation of the pressure transducer PT (or pressure switch PS), the solenoid 608 drives the control body 62 of the flow control valve 36 to the open position (see arrangement SEC B), against the bias of the solenoid return spring 70 (e.g. biasing element 70). In the event that the pressure transducer PT (or pressure switch PS) is not activated, the solenoid 608 retains the control body 62 of the flow control valve 36 in the closed position (see arrangement SEC A), via the bias of the solenoid return spring 70 (e.g. biasing element 70). Thus, activation of the pressure transducer PT or the pressure switch PS, can be used to activate the respective flow control valve 36 and thus place the flow control valve 36 in the open position. The pressure transducer PT (or pressure switch PS) of each of the flow control valves 36 can be set for a different selected pressure threshold, in order to provide for the cylinder on demand operation of the hydraulic device 12 as further described above.

It is also recognized that any of the pressure transducers PT of the hydraulic device 12 can be activated before the fluid pressure in the fluid pressure sensing line 32 reaches the set pressure threshold of the respective pressure transducer PT of the respective flow control valve 36. In this case, the control circuit 891 can be used to activate selected ones of the arrangements SEC A, SEC B, etc., by an operator of the hydraulic device 12, before the fluid pressure in the work leg 16*a* (see FIG. 1) reaches the particular set pressure threshold of the flow control valve(s) 36. This can be performed, in order to request a particular number of cylinders 120 on demand, e.g. in the event that a "maximum" or otherwise increased flow is desired from the hydraulic device 12 at fluid pressures lower than would otherwise dictate that number of cylinders 120 being demanded, i.e. configured so as to drive hydraulic fluid towards the first output gallery 240 and thus into the work leg 16*a* (see FIG. 1). For example, in the event that the hydraulic device 12 of FIG. 12 (SEC A closed and SEC B open) is operating at a reduced pressure (i.e. the pressure in the pressure sensing line 32 is less than the set pressure threshold of the flow control valve 36 of SEC A) and the operator decides that more fluid output from the first output port 24 (see FIG. 1) is desired, the operator can active manually (e.g. as an override of the pressure transducer PT of SEC A) the control circuit 891 in order to energize the solenoid 608 of SEC A (see FIG. 10 in ghosted view) and thus change the state of the flow control valve 36 of SEC A from closed to open. Once open, then both of the cylinders 120 of SEC A and SEC B would be directing hydraulic fluid towards the first output gallery 240, as shown in FIG. 10. As such, in the event that the operator of the hydraulic device actives manually (e.g. as the override of the pressure transducer PT), the control circuit 891 can be used to manually energize one or more of the solenoids 608 and thus change the operation of the hydraulic device 12 from that shown in FIG. 12 to that shown in FIG. 10. It is recognized that the change from FIG. 12 to FIG. 10 operation only shows the opening of one flow control valve 36 using the control circuit 891 as an override, however more than one flow control valve 36 can be opened at a time via the manual override capabilities offered by the control circuit 891, as desired.

Similarly, it is also recognized that any of the pressure transducers PT of the hydraulic device 12 can be deactivated after the fluid pressure in the fluid pressure sensing line 32 has reached the set pressure threshold of the respective pressure transducer PT of the respective flow control valve 36. In this case, the control circuit 891 can be used to deactivate selected ones of the arrangements SEC A, SEC B, etc., by an operator of the hydraulic device 12, after the fluid pressure in the work leg 16*a* (see FIG. 1) has reached the particular set pressure threshold of the flow control valve(s) 36. This can be performed, in order to decommission a particular number of cylinders 120 on demand, e.g. in the event that a "minimum" or otherwise decreased flow is desired from the hydraulic device 12 at fluid pressures higher than would otherwise dictate that number of cylinders 120 being demanded, i.e. configured so as to drive hydraulic fluid towards the second output gallery 40 and thus towards the bypass leg 16*b* and/or recirculation/recycling from one cylinder 120 to the next cylinder 120 via the bypass gallery 40 (see arrangement SEC A and SEC B of FIG. 9,11 having their flow control valves 36 in the closed state such that any fluid flowing first in and then out of the common second output gallery 40 would be able to flow in a recycled fashion (internal to the housing 34) via the passage 160 towards the cylinder 120 considered just downstream of the cylinder 120 that just emptied into the common secondary output gallery 40). For example, in the event that the hydraulic device 12 of FIG. 10 (SEC A open and SEC B open) is operating at an increased pressure (i.e. the pressure in the pressure sensing line 32 is greater than the set pressure threshold of the flow control valves 36 of SEC A and SEC B) and the operator decides that less fluid output from the first output port 24 (see FIG. 1) is desired, the operator can active manually (e.g. as an override of the pressure transducer PT of SEC A) the control circuit 891 in order to de-energize the solenoid 608 of SEC A (see FIG. 12) and thus change the state of the flow control valve 36 of SEC A from open to closed. Once closed, then only the cylinders 120 of SEC B would be directing hydraulic fluid towards the first output gallery 240, as shown in FIG. 12. As such, in the event that the operator of the hydraulic device activates manually (e.g. as the override of the pressure transducer PT), the control circuit 891 can be used to manually de-energize one or more of the solenoids 608 and thus change the operation of the hydraulic device 12 from that shown in FIG. 10 to that shown in FIG. 12. It is recognized that the change from FIG. 10 to FIG. 12 operation only shows the closing of one flow control valve 36 using the control circuit 891 as an override, however more than one flow control valve 36 can be closed at a time via the manual override capabilities offered by the control circuit 891, as desired.

It is also recognized that hydraulic device 12 can be operated as a motor, rather than as a pump. In this example, the hydraulic device 12 would be operated such that the cam 122 and thus shaft 123 would be driven by the reciprocation of the piston(s) 110 in their corresponding cylinder(s) 120, such that the reciprocation of the piston(s) 110 would be used to receive work from the fluid flowing from the input gallery 90 to the output gallery(ies) 240,40 (i.e. the pistons 110 would be driven by the fluid flow between the galleries 90, 40, 240). For example, as a motor, the hydraulic device 12 could be used as the load 14 in the system 10 of FIG. 1.

It is also recognized that hydraulic device 12 can be operated as a pump, rather than as a motor. In this example, the hydraulic device 12 would be operated such that the cam 122 and thus shaft 123 would drive the reciprocation of the piston(s) 110 in their corresponding cylinder(s) 120, such that the reciprocation of the piston(s) 110 would be used to impart work to the fluid flowing from the input gallery 90 to the output gallery (ies) 240, 40 (i.e. the pistons 110 would drive the fluid flow between the galleries 90, 40, 240).

It is also recognized that in an alternative embodiment, the solenoid 608 can be configured so that a deactivation (open pressure switch PS) of the solenoid 608 can provide for the return spring 70 to drive the control body 62 towards the open position, while an activation (closed pressure switch PS) of the solenoid 608 can provide for the return spring 70 to drive the control body 62 towards the closed position, as desired.

It is also recognized that rotation of the shaft 123 can be done clockwise or counterclockwise.

I claim:

1. A variable flow hydraulic device having a plurality of cylinders for varying a flow of hydraulic fluid between a reservoir and a load, the device comprising:

a housing having the plurality of cylinders with a plurality of corresponding pistons;

an input port of the housing fluidly connected to each cylinder of the plurality of cylinders, the input port facilitating introduction of the hydraulic fluid to said each cylinder;

a first output port of the housing connected to said each cylinder, the first output port facilitating the ejection of the hydraulic fluid from said each cylinder, the first output port configured for fluidly coupling said each cylinder to the load;

a respective flow control valve for said each cylinder, said respective flow control valve positioned between at least one of a) the input port and said each cylinder and b) the first output port and said each cylinder, said respective flow control valve for facilitating or inhibiting the flow of the hydraulic fluid between the input port and the first output port for said each cylinder depending upon a respective open state or a respective closed state of said respective flow control valve; and a fluid pressure sensing device coupled between downstream of the first output port and said respective flow control valve, the fluid pressure sensing device for supplying a pressure signal generated from a fluid pressure of the first output port to said respective flow control valve for operating said respective flow control valve between the open state and the closed state;

wherein when the pressure signal represents the fluid pressure as exceeding a specified maximum pressure threshold, said respective flow control valve is operated from the closed state to the open state in order to facilitate the flow of the hydraulic fluid between the input port and the first output port via said each cylinder, such that said each cylinder of the plurality of cylinders has a different one of the specified maximum pressure threshold.

2. The device of claim 1, wherein the input port is connected to a common input gallery of the housing, the common input gallery fluidly coupled to said each cylinder of the plurality of cylinders.

3. The device of claim 1, wherein the input port is connected to a common input gallery of the housing, the common input gallery fluidly coupled to said respective flow control valve of said each cylinder of the plurality of cylinders, such that said respective flow control valve is positioned between the input port and said each cylinder.

4. The device of claim 1, wherein the first output port is connected to a common output gallery of the housing, the common output gallery fluidly coupled to said each cylinder of the plurality of cylinders.

5. The device of claim 1, wherein the first output port is connected to a common output gallery of the housing, the common output gallery fluidly coupled to said respective flow control valve of said each cylinder of the plurality of cylinders, such that said respective flow control valve is positioned between the first output port and said each cylinder.

6. The device of claim 1, wherein the fluid pressure sensing device includes a pressure transducer for sensing the fluid pressure and generating an electronic signal as the pressure signal for use by said respective flow control valve to operate from the closed state to the open state.

7. The device of claim 6, wherein said respective flow control valve includes a solenoid operated by the electronic signal when received.

8. The device of claim 6 further comprising said respective flow control valve having:

a control cylinder having one end and a biasing element positioned at another end opposite the one end, the biasing element biasing a valve in the control cylinder towards the one end thereby placing said respective fluid control valve in the closed state;

the valve configured for reciprocation within the control cylinder between the one end and the another end, such that presence of the electronic signal as indicative of the fluid pressure exceeding the specified maximum pressure threshold for said each cylinder causes the valve to act against said biasing in order to place said respective fluid control valve in the open state; and a port in a body of the valve, the port positioned in the control cylinder during the open state to facilitate the hydraulic fluid a) flowing from the input port to said each cylinder when said respective flow control valve is positioned between the input port and said each cylinder or b) flowing from said each cylinder to the output port when said respective flow control valve is positioned between the first output port and said each cylinder.

9. The device of claim 1, wherein the fluid pressure sensing device is a hydraulic fluid conduit for supplying a portion of the hydraulic fluid from the first output port to said respective flow control valve as the pressure signal for use by said respective flow control valve to operate from the closed state to the open state.

10. The device of claim 9 further comprising said respective flow control valve having:

a control cylinder hydraulically coupled at one end to the hydraulic fluid conduit and having a biasing element positioned at another end opposite the one end, the biasing element biasing a valve in the control cylinder towards the one end thereby placing said respective fluid control valve in the closed state;

the valve configured for reciprocation within the control cylinder between the one end and the another end, such that presence of the portion of the hydraulic fluid at the one end as indicative of the fluid pressure exceeding the specified maximum pressure threshold for said each cylinder causes the valve to act against said biasing in order to place said respective fluid control valve in the open state; and a port in a body of the valve, the port positioned in the control cylinder during the open state to facilitate the hydraulic fluid a) flowing from the input port to said each cylinder when said respective flow control valve is positioned between the input port and said each cylinder or b) flowing from said each cylinder to the output port when said respective flow control valve is positioned between the first output port and said each cylinder.

11. The device of claim 10 further comprising said respective flow control valve having a trigger device, the trigger device having:

a trigger valve fluidly positioned between the one end and the hydraulic fluid conduit;

a trigger input port of the trigger valve fluidly coupled to the hydraulic fluid conduit in order to receive the portion of the hydraulic fluid;

a trigger output port of the trigger valve coupled to the one end in order to output the portion of the hydraulic fluid to the one end when the trigger device is in a trigger on state;

the trigger valve biased by a trigger biasing element towards a trigger off state;

wherein receipt of the portion of the hydraulic fluid by the trigger device as indicative of the fluid pressure exceeding the specified maximum pressure threshold for said each cylinder causes the trigger valve to act against the trigger biasing element in order to facilitate flow of the portion from the trigger input port to the one end via the trigger output port, the trigger device in the trigger on state.

12. The device of claim 11, the trigger device further comprising:

the trigger valve being a trigger shuttle valve positioned for reciprocation in a trigger cylinder, the trigger shuttle valve having a trigger port in a trigger body;

the trigger biasing element positioned at one end of the trigger shuttle valve opposite the trigger input port;

the trigger biasing element sized according to the specified maximum pressure threshold for said each cylinder, such that a) when the portion of the hydraulic fluid is at the fluid pressure less than the specified maximum pressure threshold for said each cylinder, the trigger device is in the trigger off state as the trigger body blocks fluid communication of the portion between the trigger input port and the trigger output port or b) when the portion of the hydraulic fluid is at the fluid pressure exceeding the specified maximum pressure threshold for said each cylinder, the trigger device is in the trigger on state as the trigger body acts against the trigger biasing element in order to move the trigger port between the trigger input port and the trigger output port in order to facilitate fluid communication of the portion to the one end of the control cylinder.

13. The device of claim 1, wherein said each cylinder is provided as:

a first cylinder, the first cylinder having a corresponding first flow control device and a corresponding first fluid pressure sensing device correlated to a first maximum pressure threshold, the first pressure sensing device for supplying a first pressure signal;

a second cylinder, the second cylinder having a corresponding second flow control device and a corresponding second fluid pressure sensing device correlated to a second maximum pressure threshold, the second pressure sensing device for supplying a second pressure signal, the first maximum pressure threshold less than the second maximum pressure threshold;

wherein when the fluid pressure reaches the first maximum pressure threshold while also being less than the second maximum pressure threshold, the first pressure signal causes the first flow control valve to be positioned in the open state while the second pressure signal causes the second flow control valve to remain in the closed state, whereby the flow of the hydraulic fluid from the input port to the first output port by the first cylinder is facilitated while the flow of the hydraulic fluid from the input port to the first output port by the second cylinder is inhibited.

14. The device of claim 1, wherein said each cylinder is provided as:

a first cylinder, the first cylinder having a corresponding first flow control device and a corresponding first fluid pressure sensing device correlated to a first maximum pressure threshold, the first pressure sensing device for supplying a first pressure signal;

a second cylinder, the second cylinder having a corresponding second flow control device and a corresponding second fluid pressure sensing device correlated to a second maximum pressure threshold, the second pressure sensing device for supplying a second pressure signal, the first maximum pressure threshold less than the second maximum pressure threshold;

wherein when the fluid pressure surpasses the second maximum pressure threshold while, the first pressure signal maintains the first flow control valve as positioned in the open state while the second pressure signal causes the second flow control valve to be positioned from the closed state to the open state, whereby the flow of the hydraulic fluid from the input port to the first output port by the second cylinder joins a current flow of the hydraulic fluid from the input port to the first output port by the first cylinder.

15. The device of claim 1, wherein when the pressure signal represents the fluid pressure as exceeding a specified first maximum pressure threshold of a first cylinder of the plurality of cylinders but not a specified second maximum pressure threshold of a second cylinder of the plurality of cylinders, such that a first flow control valve of the first cylinder is operated from the closed state to the open state in order to facilitate the flow of the hydraulic fluid between the input port and the first output port via the first cylinder while a second flow control valve of the second cylinder remains in the closed state in order to inhibit the flow of the hydraulic fluid between the input port and the first output port via the second cylinder, the specified first maximum pressure threshold less than the specified second maximum pressure threshold.

16. The device of claim 1, wherein when the pressure signal represents the fluid pressure as exceeding a specified second maximum pressure threshold of a second cylinder of the plurality of cylinders after already exceeding a specified first maximum pressure threshold of a first cylinder of the plurality of cylinders, such that a second flow control valve of the second cylinder is operated from the closed state to the open state in order to facilitate the flow of the hydraulic fluid between the input port and the first output port via the second cylinder while a first flow control valve of the first cylinder remains in the open state in order to continue flow of the hydraulic fluid between the input port and the first output port via the first cylinder, the specified first maximum pressure threshold less than the specified second maximum pressure threshold.

17. The device of claim 1 further comprising a second output port fluidly coupled to said each cylinder, wherein said respective flow control valve is positioned between a) the first output port and said each cylinder and b) the second output port and said each cylinder.

18. The device of claim 17, wherein when said respective flow control valve is in the closed state the pressure signal represents the fluid pressure as below the specified maximum pressure threshold, said respective flow control valve in the closed state facilitates the flow of the hydraulic fluid between the input port and the second output port via said each cylinder, the second output port connected to a second common output gallery coupled to each of the plurality of cylinders, such that the flow of the hydraulic fluid in the second common output gallery bypasses the load by at least one of a) flowing to a fluid input of another cylinder of the plurality of cylinders and b) flowing via a fluid communication path coupled to the reservoir.

19. The device of claim 17, wherein the fluid communication path is coupled to a heat exchanger positioned between the second common output gallery and the reservoir.

20. A variable flow hydraulic device having a first cylinder and a second cylinder for varying a flow of hydraulic fluid from a reservoir to a load, the device comprising:

a housing having the first cylinder and the second cylinder, the first cylinder and the second cylinder each having a corresponding piston for guiding the hydraulic fluid into and out of the respective cylinder;

an input port of the housing fluidly connected to each of the first cylinder and the second cylinder, the input port facilitating introduction of the hydraulic fluid to the first cylinder and the second cylinder;

a first common output port of the housing connected to the first cylinder and the second cylinder, the first common output port facilitating the ejection of the hydraulic fluid from the first cylinder and the second cylinder, the first common output port configured for fluidly coupling the first cylinder and the second cylinder to the load;

a first flow control valve for the first cylinder, said first flow control valve positioned between at least one of a) the input port and the first cylinder and b) the first common output port and the first cylinder, the first flow control valve for facilitating or inhibiting the flow of the hydraulic fluid between the input port and the first common output port for the first cylinder depending upon an open state or a closed state of the first flow control valve, movement of the first flow control valve from the closed state to the open state dependent upon a fluid pressure of the common output port exceeding a first maximum pressure threshold;

a second flow control valve for the second cylinder, said second flow control valve positioned between at least one of a) the input port and the second cylinder and b) the first common output port and the second cylinder, the second flow control valve for facilitating or inhibiting the flow of the hydraulic fluid between the input port and the first common output port for the second cylinder depending upon an open state or a closed state of the second flow control valve, movement of the second flow control valve from the closed state to the open state dependent upon the fluid pressure of the common output port exceeding a second maximum pressure threshold, the second maximum pressure threshold less that the first maximum pressure threshold;

a first fluid pressure sensing device coupled between the first common output port and the first flow control valve, the first fluid pressure sensing device for supplying a first pressure signal generated from the fluid pressure to the first flow control valve for operating the first flow control valve between the open state and the closed state;

a second fluid pressure sensing device coupled between the first common output port and the second flow control valve, the second fluid pressure sensing device for supplying a second pressure signal generated from the fluid pressure to the second flow control valve for operating the second flow control valve between the open state and the closed state;

wherein when the first pressure signal represents the fluid pressure as exceeding the first maximum pressure threshold while the second pressure signal represents the fluid pressure as not exceeding the second maximum pressure threshold, the first flow control valve is operated from the closed state to the open state in order to facilitate the flow of the hydraulic fluid between the input port and the first common output port via the first cylinder and the second flow control valve remains in the closed state in order to inhibit the flow of the hydraulic fluid between the input port and the first common output port via the second cylinder.

21. The device of claim 1, wherein the device is a pump.

* * * * *